US005943526A

United States Patent [19]

Kodama

[11] Patent Number: 5,943,526

[45] Date of Patent: Aug. 24, 1999

[54] IMAGE FORMING APPARATUS WITH AN IMPEDANCE VARYING DEVICE AND METHOD OF USING SAME

[75] Inventor: Hideaki Kodama, Okazaki, Japan

[73] Assignee: Minolta Co., Ltd., Osaka, Japan

[21] Appl. No.: 09/069,139

[22] Filed: Apr. 29, 1998

[30] Foreign Application Priority Data

May 8, 1997 [JP] Japan ..... 9-117650
May 23, 1997 [JP] Japan ..... 9-133488

[51] Int. Cl.[6] ..... G03G 15/16; G03G 15/00

[52] U.S. Cl. ..... 399/66; 399/26; 399/312

[58] Field of Search ..... 399/26, 43, 45, 399/50, 66, 312, 313, 148

[56] References Cited

U.S. PATENT DOCUMENTS 4,360,262 11/1982 Genthe ..... 399/148
5,128,717 7/1992 Uchikawa et al. .
5,182,603 1/1993 Yamada .

FOREIGN PATENT DOCUMENTS 63-228179 9/1988 Japan .
4-190381 7/1992 Japan .
6-27831 2/1994 Japan .
6-118814 4/1994 Japan .
9-120217 5/1997 Japan .

*Primary Examiner*—Joan Pendegrass
*Attorney, Agent, or Firm*—Burns, Doane, Swecker & Mathis, LLP

[57] ABSTRACT

An image forming apparatus gets information on the thickness of the photosensitive layer by using the image transfer power source and transfer brush, and controls the contact position of the transfer brush on the paper carrying belt based on the thickness information, so that in case the photosensitive layer wears thin partially due to the long-term use, the apparatus increases in compensation the impedance of the carrying belt in its section from the image transfer zone to the contact position of the transfer brush. The apparatus may be designed to use selectively multiple transfer brushes having different impedances, instead of the position control of one transfer brush. Consequently, the apparatus can retain the difference of impedance between the toner image portion and non-toner image portion in the transfer zone of the photosensitive layer and thus can retain the unevenness of transfer electric field distribution across the transfer zone in the same degree as with a new photosensitive layer, whereby it performs high-quality image formation without the occurrence of dropout throughout the long-term use. For a multi-color image forming apparatus, the image forming unit for black color that is most sensitive to the print quality implements the impedance control.

26 Claims, 16 Drawing Sheets

IMAGE FORMING APPARATUS WITH AN IMPEDANCE VARYING DEVICE AND METHOD OF USING SAME

This application is based on applications Nos. 9-117650, and 9-133488 filed in Japan, the contents of which is hereby incorporated by reference.

BACKGROUND OF THE INVENTION

1. Field of the Invention

The present invention relates to an image forming apparatus which transfers a toner image formed on the photosensitive layer onto a recording medium, or an image forming apparatus which transfers toner images of multiple colors formed on the photosensitive layer onto a transfer target medium by superimposition to print a colored image. More particularly, the present invention relates to an image forming apparatus which is capable of preventing the dropout of image even if the impedance between the base cylinder which supports the photosensitive layer and the transfer device varies due to the long-term use or varies depending on the type of recording medium.

2. Description of the Related Art

The image forming apparatus based on electrophotography operates to transfer a toner image formed on the photosensitive layer onto a recording medium such as print paper (will be termed "print paper" hereinafter) based on the application of a static electric field. FIG. 13 shows in a sense of model the cross section of the place where the transfer of image is taking place. Specifically, the figure shows the cross section of the place where a photosensitive drum 10 which has a photosensitive layer 12 formed on a base cylinder 11 and a carrying belt 26 which bears and transports a sheet of print paper P are closest to each other (this place will be called "transfer zone" hereinafter).

On the rear side of the carrying belt 26 at the transfer zone, there is disposed a transfer brush 20 which charges the carrying belt 26 to produce an electric field. The transfer brush 20 has the application of a positive voltage relative to the base cylinder 11 by a transfer power source 21. In operation, when the transfer brush 20 is supplied with the positive voltage from the transfer power source 21, toner T which is negatively charged on the photosensitive layer 12 is attracted by the electric field existing between the photosensitive layer 12 and the print paper P and transferred to the print paper P.

In the case of a multi-color image forming apparatus, toner images of individual colors are formed on the photosensitive layer and transferred to the print paper one by one.

FIG. 14 shows the distribution of electric field generation in the place between the photosensitive layer 12 and the print paper P. The graph reveals that the magnitude of electric field has peaks at both edges of a toner image and is smaller in the central portion of the image. This electric field distribution is conceivably attributable to the effect of the lateral component of electric field resulting from different electrical conditions between an image portion with toner (will be called "toner image portion") and an image portion without toner (will be called "non-toner image portion"). Two major electrical conditions relevant to this situation are: (1) the surface potential of the photosensitive layer 12, and (2) the impedance between the base cylinder 11 and the transfer power source 21.

The following explains the impedance between the base cylinder 11 and the transfer power source 21. The impedance of the circuit of the section shown in FIG. 13 is treated in terms of the equivalent circuit as shown in FIG. 12. Specifically, the impedance of this section is equivalently a parallel connection of an impedance $Z_0$ of the toner image portion and impedances $Z_1$ of the two non-toner image portions.

The impedance $Z_0$ of toner image portion is expressed to be a serial connection of the impedances $Z_C$, $Z_T$, $Z_P$ and $Z_B$ of the photosensitive layer 12, layer of toner T, print paper P, and carrying belt 26 (inclusive of the transfer brush 20), respectively, as follows.

$$Z_0=Z_C+Z_T+Z_P+Z_B \tag{1}$$

The impedance $Z_1$ of non-toner image portion is expressed similarly to the impedance $Z_0$ of toner image portion, with the impedance $Z_T$ of toner layer being replaced with the impedance $Z_A$ of air gap as follows.

$$Z_1=Z_C+Z_A+Z_P+Z_B \tag{2}$$

Accordingly, the difference between $Z_0$ and $Z_1$ resulting from their $Z_T$ and $Z_A$ ($Z_T>Z_A$, thus $Z_0>Z_1$) is the major basis of the electric field distribution shown on the graph of FIG. 14.

It should be noted that the equivalent circuit of FIG. 12 and the above expressions (1) and (2) do not directly show themselves the effect of the lateral component of electric field. The electric field distribution shown in FIG. 14 is not solely attributable to the difference of the above-mentioned two conditions between the toner image portion and non-toner image portions, but the edge effect resulting from the difference also acts on the lateral component of electric field. On this account, for a wide toner image portion, a weaker electric field is liable to emerge immediately inside of the edge of toner image rather than the center of image, as shown on the graph of FIG. 16.

This uneven electric field distribution across the toner image results presumably in the occurrence of dropout in the toner image formed on the print paper P, because of insufficient transfer of toner in the central portion of toner image where the electric field strength can be weak relatively.

For coping with this matter, practical image forming apparatus are designed to set the transfer output such that toner is transferred sufficiently to the toner image center where the electric field strength is weak relatively. In addition, some image forming apparatus is designed to control the transfer output depending on such an environmental factor as the humidity thereby to cope with the variation in the impedance of the air gap and print paper, as described in JP-A-Hei-4-190381 for example. Some multi-color image forming apparatus is designed to control the transfer current separately for the photosensitive substance of each color, as describe in JP-A-Sho-63-228179.

However, the foregoing conventional image forming apparatus have the following problems.

Both the impedances $Z_0$ and $Z_1$ of the toner image portion and non-toner image portion include the impedance $Z_C$ of the photosensitive layer 12, as indicated by the expressions (1) and (2). If the thickness of photosensitive layer 12 decreases due to the long-term use, the impedance $Z_C$ becomes smaller, and $Z_C$ and $Z_A$ of the toner and air gap contribute increasingly to the values of $Z_0$ and $Z_1$. The value of ratio $Z_0/Z_1$ (greater than one) increases progressively during the long-term use of the photosensitive layer 12, and the unevenness of the electric field distribution grows (refer to FIG. 15). Consequently, even though the transfer output is set appropriately for a new photosensitive layer 12, the dropout will be liable to occur during the long-term use.

Another problem is induced by the influence of the kind of print paper P, since the impedances $Z_0$ and $Z_1$ also include the impedance $Z_P$, of print paper P. Specifically, print paper P having a smaller impedance is liable to cause the dropout similar to the case of the long-term use. Moreover, print paper P has its impedance affected by the environment (particularly, the humidity), and therefore it can have a smaller impedance.

Although these problems can conceivably be coped with based on the control of transfer output by the apparatus proposed in the above-mentioned publication, the unevenness of electric field distribution cannot be alleviated by the transfer output control which merely moves vertically the whole curve of electric field distribution of FIG. 15. Accordingly, increasing the transfer output will prevent the occurrence of dropout, while at the same time an excessive transfer output will incur such a side effect as reverse (recurrent) transfer at the edge section.

In the case of a multi-color image forming apparatus, the dropout occurring particularly in a black toner image severely damages the picture quality. The reason is that even a colored image is dominated by black portions for characters and thin lines, and it is printed by mainly using black toner and using little toner of other colors (cyanine, magenta and yellow) in general. The image forming apparatus of the above-mentioned JP-A-Sho-63-228179 does not consider the significance of black toner.

SUMMARY OF THE INVENTION

The present invention is intended to solve the foregoing problems of the conventional image forming apparatus, and its prime object is to provide an image forming apparatus capable of preventing the occurrence of dropout of image without incurring the side effect by alleviating the unevenness of electric field distribution in the place between the base cylinder and the transfer device against the impedance variation of the place attributable to the long-term use, the type of recording medium, and the like.

Another object of the present invention is to provide a multi-color image forming apparatus which deals with the above-mentioned matter in transferring a toner image of a specific color that is most crucial for image formation.

In order to achieve the above objectives, the inventive image forming apparatus comprises an image retaining medium which retains a latent image on the surface thereof, a developing device which produces a visual image from the latent image that is retained on the image retaining medium, a transfer device which transfers the visual image formed on the image retaining medium onto a transfer target medium, a state sensing device which detects the state of the image retaining medium and/or an impedance measuring device which measures the impedance between the top and rear sides of the transfer target medium, and an impedance varying device which varies the impedance between the image retaining medium and the transfer device in accordance with the result of detection by the state sensing device and/or the result of measurement by the impedance measuring device.

In this image forming apparatus, a latent image is formed on the surface of the image retaining medium, and next a visual image is produced from the latent image by the developing device. The visual image is transferred onto the transfer target medium by the transfer device so that the image is printed on it.

During the image formation, at least one of the detection of the state of image retaining medium by the state sensing device and the measurement of the impedance between the top and rear sides of the transfer target medium by the impedance measuring device is taking place. The impedance varying device varies the impedance between the image retaining medium and the transfer device in accordance with the result of detection by the state sensing device and/or the result of measurement by the impedance measuring device such that the ratio of the values of impedance in a place with a visual image and a place without a visual image between the image retaining medium and the transfer device becomes close to one.

The impedance control alleviates the unevenness of electric field distribution in the place between the image retaining medium and the transfer device, enabling the transfer of image without the occurrence of dropout. Consequently, this image forming apparatus prevents the occurrence of dropout of image caused by the unevenness of electric field distribution in the place between the image retaining medium and the transfer device irrespective of the state of image retaining medium, the type of transfer target medium and the environment.

The impedance between the image retaining medium and the transfer device includes the resistance, reactance and capacitance, although it is sufficient to treat only d.c. resistance in most cases.

Alternatively, the inventive image forming apparatus has a unit arrangement, which comprises an image retaining medium which retains a latent image on the surface thereof, a developing device which produces a visual image from the latent image that is retained on the image retaining medium, a transfer device which transfers the visual image formed on the image retaining medium onto a transfer target medium, a state sensing device which detects the state of the image retaining medium and/or an impedance measuring device which measures the impedance between the top and rear sides of the transfer target medium, and an impedance varying device which varies the impedance between the image retaining medium and the transfer device in accordance with the result of detection by the state sensing device and/or the result of measurement by the impedance measuring device.

Alternatively, the inventive image forming apparatus includes a plurality of the image forming unit, with the impedance between the image retaining medium and the transfer device being allowed to differ among the image forming units. Particularly, it is desirable to make different the impedance of the unit for a specific color (e.g., black), which is used most in quantity among the image forming units, from the impedance of other units. In this case, the impedance varying device may be provided only for the unit of the specific color.

Alternatively, the inventive image forming apparatus further includes a carrying belt which transports the transfer target medium to pass through the gap between the image retaining medium and the transfer device, and the transfer device includes a contact transfer device which charges the carrying belt by being in contact with the rear side thereof. In this case, the impedance varying device may be a position varying device which varies the contact position of the contact transfer device on the rear side of the carrying belt.

In this arrangement, the transfer target medium moves between the image retaining medium and the transfer device by being carried by the carrying belt. The carrying belt is in contact on its rear side with the contact transfer device of the transfer device, and it is charged. Consequently, an electric field is produced in the gap between the image retaining medium and the transfer device, and the visual image on the photosensitive layer is transferred to the transfer target medium. The position varying device varies the contact position of the contact transfer device on the rear side of the carrying belt in accordance with the result of detection by the state sensing device or the result of measurement by the impedance measuring device. Consequently, the impedance between the position of carrying belt nearest to the image retaining medium and the position in contact with the contact transfer device is adjusted to match with the detection or measurement result. After that, the contact transfer device keeps the contact position on the rear side of the carrying belt and charges the surface for image transfer.

In this case, it is suitable for the impedance measuring device to be disposed on the upstream side of the transfer device on the path of transfer target medium, so that the impedance between the image retaining medium and the transfer device is measured by the impedance measuring device and controlled optimally by the impedance varying device for each piece of transfer target medium before it is rendered the image transfer by the transfer device. In the above-mentioned case of multi-unit arrangement, the impedance measuring device is adapted to measure the impedance between the image retaining medium and the transfer device of a unit that is located on the upstream side of the unit for the specific color on the path of transfer target medium.

Alternatively, the inventive image forming apparatus includes a plurality of the contact transfer device, and the impedance of each contact transfer device is different preferably. In this case, the impedance varying device includes a switching device which switches among the contact transfer devices, and the transfer device charges the rear side of the carrying belt with one of the contact transfer devices. At varying the impedance between the image retaining medium and the transfer device in accordance with the result detection by the state sensing device or the result of measurement by the impedance measuring device, one of the contact transfer devices having the impedance that best matches with the detection or measurement result is selected by the switching device, and is kept used thereafter.

In the inventive image forming apparatus, the image retaining medium preferably includes a conductive base and a photosensitive layer, and the state sensing device detects the thickness of photosensitive layer which is one of factors influential on the impedance between the image retaining medium (specifically, the conductive base) and the transfer device, since the photosensitive layer wears thin during the use, resulting in a varied impedance between the conductive base and the transfer device.

In this case, the image retaining medium retains the latent image on its photosensitive layer, and the impedance varying device varies the impedance between the conductive base and the transfer device in accordance with the thickness of the photosensitive layer detected by the state sensing device. Accordingly, the impedance between the conductive base and the transfer device is kept appropriate even after a new photosensitive layer wears thin. Consequently, the unevenness of electric field distribution in the place between the conductive base and the transfer device is alleviated, and image transfer without the occurrence of dropout is made possible.

In this case, the inventive image forming apparatus may further include a contact charging device which charges the photosensitive layer by being in contact with it, and the state sensing device detects the thickness of the photosensitive layer based on the impedance measurement in terms of the relation of the current and voltage on the contact charging device.

In this case, formation of a latent image on the photosensitive layer is preceded by charging of the photosensitive layer by the contact charging device. At the detection of the state of image retaining medium, the state sensing device measures the impedance of photosensitive layer in terms of the relation of the current and voltage on the contact charging device based on the fact that the impedance of photosensitive layer is virtually proportional to its thickness. The impedance varying device varies the impedance between the conductive base and the transfer device in accordance with the detected thickness of the photosensitive layer. Consequently, the impedance between the conductive base and the transfer device is kept appropriate so that image transfer takes place normally even after a new photosensitive layer wears thin due to the long-term use.

Alternatively, the inventive image forming apparatus further includes a carrying belt which transports the transfer target medium to pass through the gap between the image retaining medium and the transfer device, and in case the transfer device includes a contact transfer device which charges the carrying belt by being in contact with the rear side thereof, the state sensing device detects the thickness of photosensitive layer based on the impedance measurement in terms of the relation of the current and voltage on the contact transfer device.

At the detection of the state of image retaining medium, the state sensing device measures the impedance of the photosensitive layer in terms of the relation of the current and voltage on the contact transfer device. The impedance varying device varies the impedance between the conductive base and the transfer device in accordance with the detected thickness of the photosensitive layer.

The impedance measurement conducted by the inventive image forming apparatus can be based on any of the following two schemes.

(i) The photosensitive layer is charged so that the voltage between the contact charging device or contact transfer device and the photosensitive layer has a certain value, and then the device current is measured.

(ii) The photosensitive layer is charged so that the current flowing between the contact charging device or contact transfer device and the photosensitive layer has a certain value, and then the device voltage is measured.

Contact charging devices useful for the inventive image forming apparatus include a charging brush, charging sheet, charging blade and charge roller, which are all used widely for the charger or charge eliminater for the photosensitive layer. Any of the charging brush, charging sheet, charging blade and charge roller is useful for the contact transfer device of the inventive image forming apparatus.

Alternatively, the inventive image forming apparatus includes a state sensing device which detects the thickness of photosensitive layer based on the counting of the number of times of image formation. Namely, the photosensitive layer wears thin progressively due to repeated image formation, and accordingly the approximate thickness of photosensitive layer can be evaluated from the count of the number of times of image formation based on the prior assessment of the relation between the thickness and the number of times of image formation.

DESCRIPTION OF THE PREFERRED EMBODIMENTS

Figure 1:
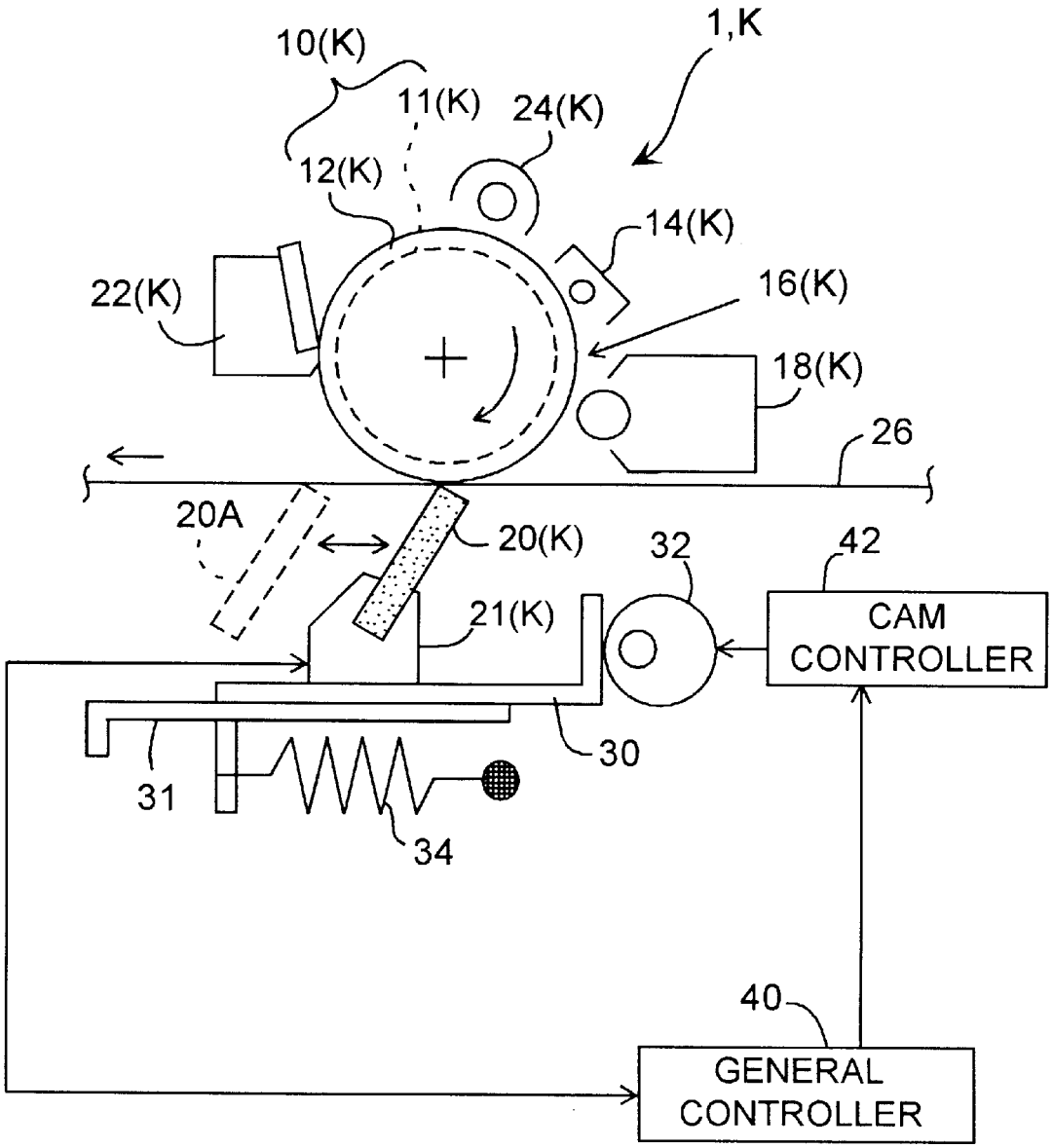
FIG. 1 is a schematic diagram showing the image forming apparatus based on a first embodiment of this invention.

Several image forming apparatus which embody the present invention will be explained in detail with reference to the drawings. In the following explanation of embodiments, identical component parts are referred to by the same reference numerals.

Embodiment 1

FIG. 1 shows an image forming apparatus 1 based on the first embodiment of this invention. The apparatus 1 includes a photosensitive drum 10 which consists of a base cylinder 11 and a photosensitive layer 12 formed on it, and a charger 14, a light exposure device 16, a developer 18, a transfer brush 20, a cleaner 22 and a charge eliminater 24 all disposed to surround the photosensitive drum 10. Disposed between the photosensitive drum 10 and the transfer brush 20 is an endless transfer belt (carrying belt) 26 which bears and transports a sheet of print paper.

In FIG. 1, the reference numerals of these devices are suffixed with "K" expediently for the later explanation of the seventh embodiment, and it should be disregarded in the explanation of the first embodiment.

On the rear side of the transfer belt 26 (opposite to the photosensitive drum 10), a brush rail 31 is laid to extend in parallel to the transfer belt 26, and a brush holder 30 is fitted on it slideably. A transfer power source 21 which supplies charges to the transfer brush 20 is fixed on the brush holder 30. Accordingly, the integrated member including the brush holder 30, transfer power source 21 and transfer brush 20 can move on the brush rail 31.

Further disposed beneath the transfer belt 26 are an eccentric cam 32 which pushes the brush holder 30, and an extension spring 34 which pulls the brush holder 30 to be in press contact with the eccentric cam 32. In operation, the eccentric cam 32 is turned to move the brush holder 30 on the brush rail 31, so that the contact position of the transfer brush 20 on the transfer belt 26 is varied. The transfer brush 20 shown as a filled image in FIG. 1 is located at the position where the photosensitive drum 10 and the transfer belt 26 are closest to each other, whereas the transfer brush 20A shown as a dashed-line image is located with some distance from that position.

The transfer power source 21 can work either as a constant voltage source with a current metering function or a constant current source with a voltage metering function.

The image forming apparatus 1 has control systems, of which one is directed by a general controller 40 which controls the overall apparatus and another is directed by a cam controller 42 which controls the eccentric cam 32 in accordance with the command from the general controller 40. The general controller 40 controls the transfer power source 21 to supply charges to the transfer brush 20, controls the driving of the photosensitive drum 10 and transfer belt 26, and controls the light emission of the exposure device 16.

The basic image forming operation of the image forming apparatus 1 is as follows. The charger 14 is activated to charge the photosensitive layer 12 of the photosensitive drum 10 to have a prescribed potential, while the drum 10 is turned in the clockwise direction on the drawing. The exposure device 16 is activated to emit a laser beam, which is modulated by image data, to the photosensitive layer 12, and a static latent image is formed in the charged section. Toner, which is charged negatively by the developer 18, is put to the static latent image, and the latent image is converted into a toner image.

During these operations, the transfer belt 26 on which (the upper side nearer to the photosensitive drum 10) a sheet of print paper is borne is running by being synchronized in surface speed with the photosensitive drum 10. The transfer belt 26 is charged positively on its rear side by the transfer brush 20, and an electric field is produced in the closest place between the transfer belt 26 and the photosensitive drum 10, i.e., transfer zone.

When the toner image on the photosensitive layer 12 reaches the transfer zone by the rotation of the drum 10, toner is attracted by the electric field and the toner image is transferred to the print paper. The print paper, with the toner image being transferred thereto, is further carried by the transfer belt 26 to the fixer, by which the toner image is fixed to become a printed image on the print paper.

The photosensitive layer 12 still has a small amount of residual toner. When this residual toner image reaches the cleaner 22 by the rotation of the drum 10, the residual toner is removed by the cleaner 22. The charge eliminater 24 removes the remaining charges on the photosensitive layer 12, and the apparatus is ready for the next image formation. These image forming operations are conducted by the general controller 40.

Besides the foregoing basic operation, the image forming apparatus 1 implements the control for varying the contact position of the transfer brush 20 on the transfer belt 26 with the intention of alleviating the unevenness of electric field distribution across the transfer zone due to the long-term use of the photosensitive layer 12 thereby to prevent the dropout of the toner image to be transferred to the print paper.

Figure 12:
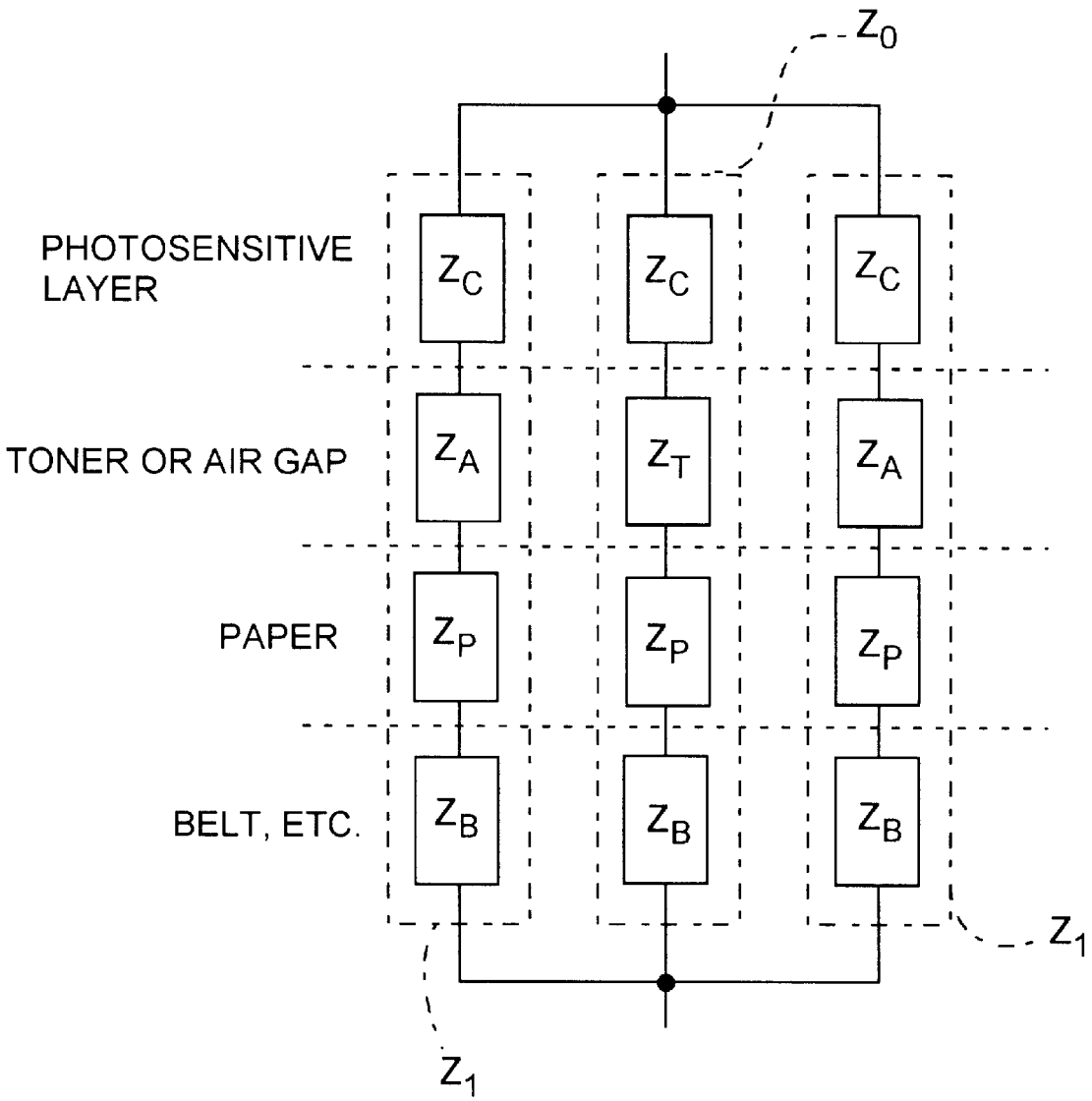
FIG. 12 is a diagram of the equivalent circuit used to analyze the impedance components of the transfer zone.
Figure 13:
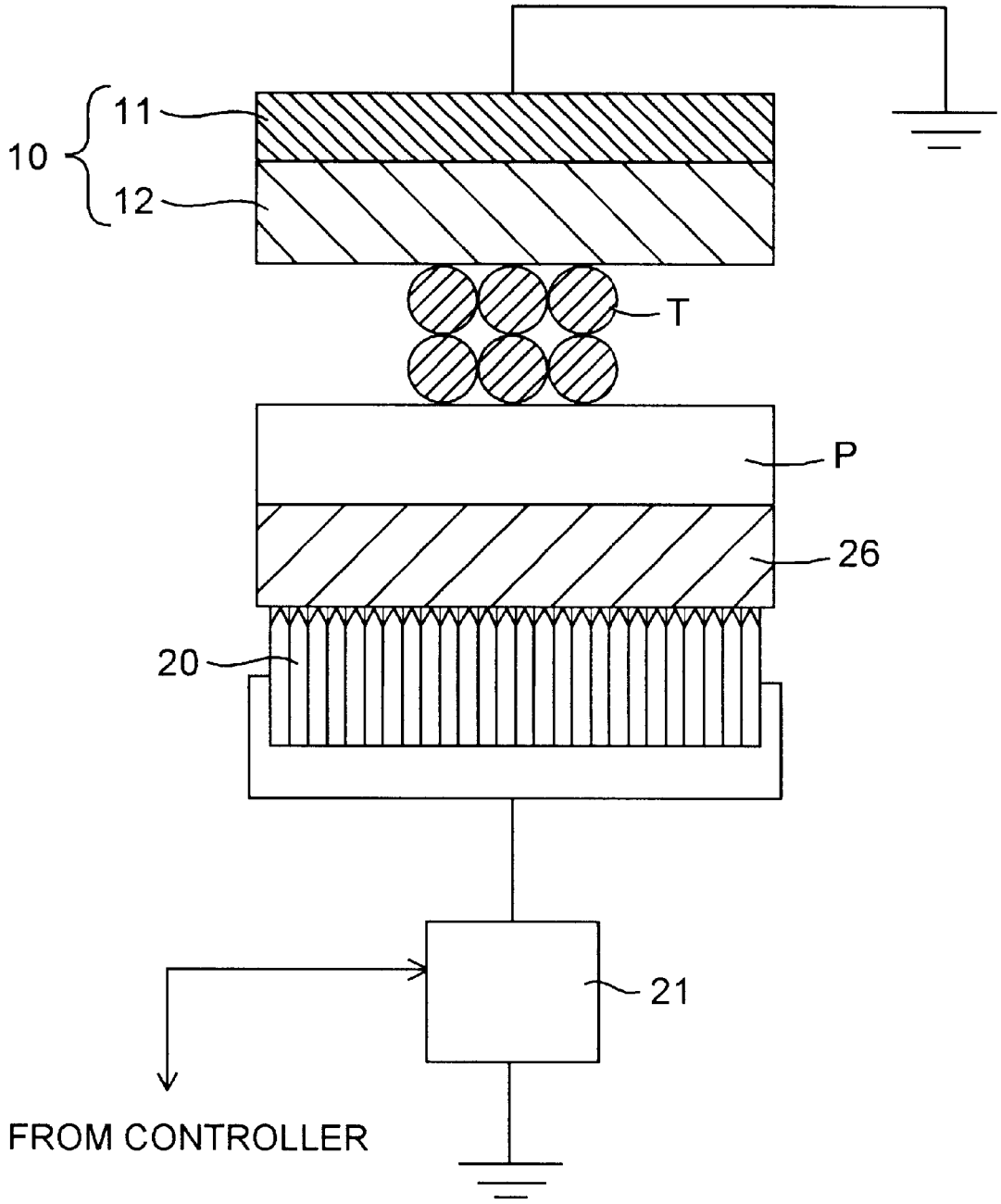
PRIOR ART FIG. 13
FIG. 13 is a diagram showing in a sense of model the cross section of the transfer zone of the conventional image forming apparatus.
Figure 14:
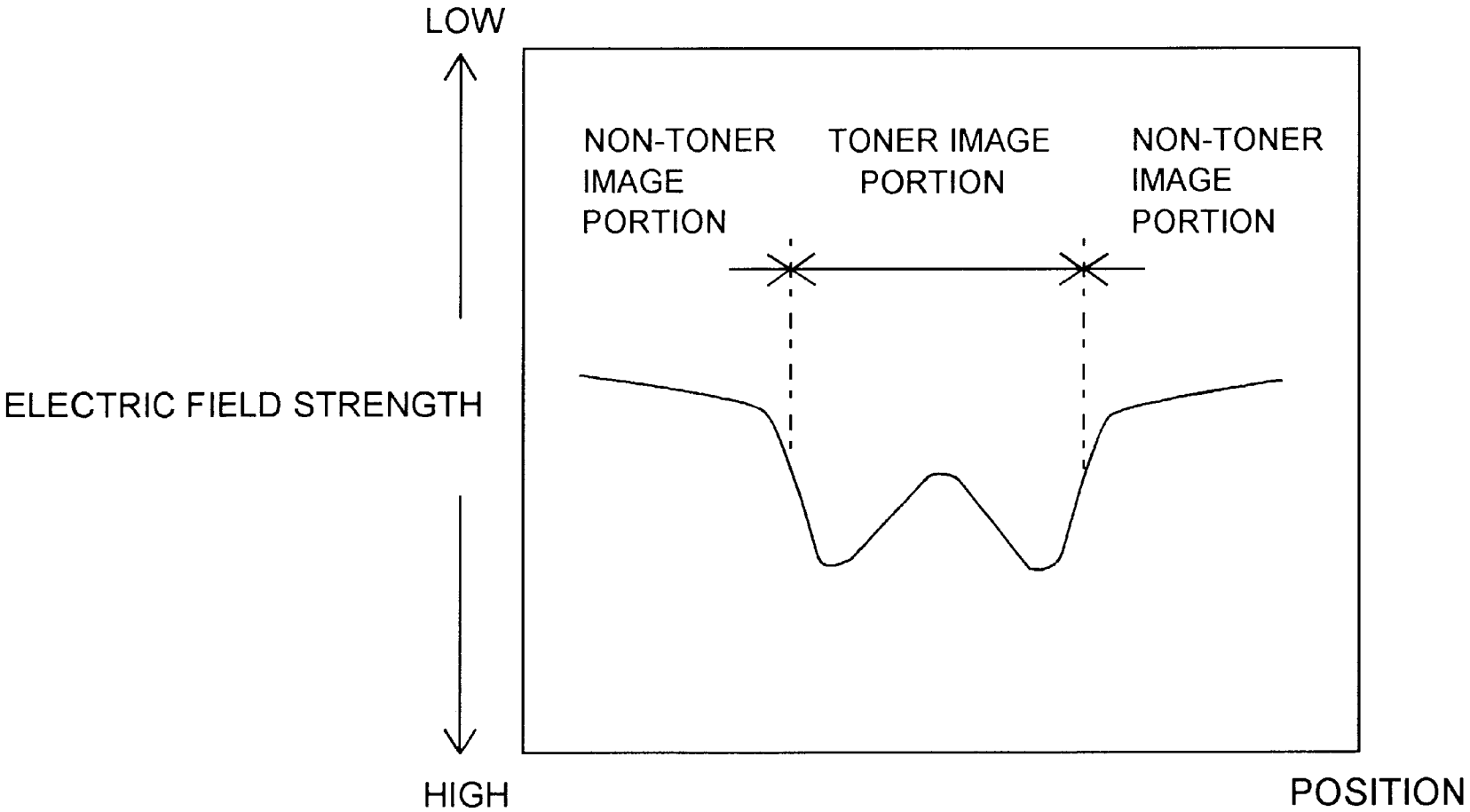
FIG. 14 is a graph relevant to a new photosensitive layer, showing the electric field distribution across the transfer zone having a narrow image pattern.
Figure 15:
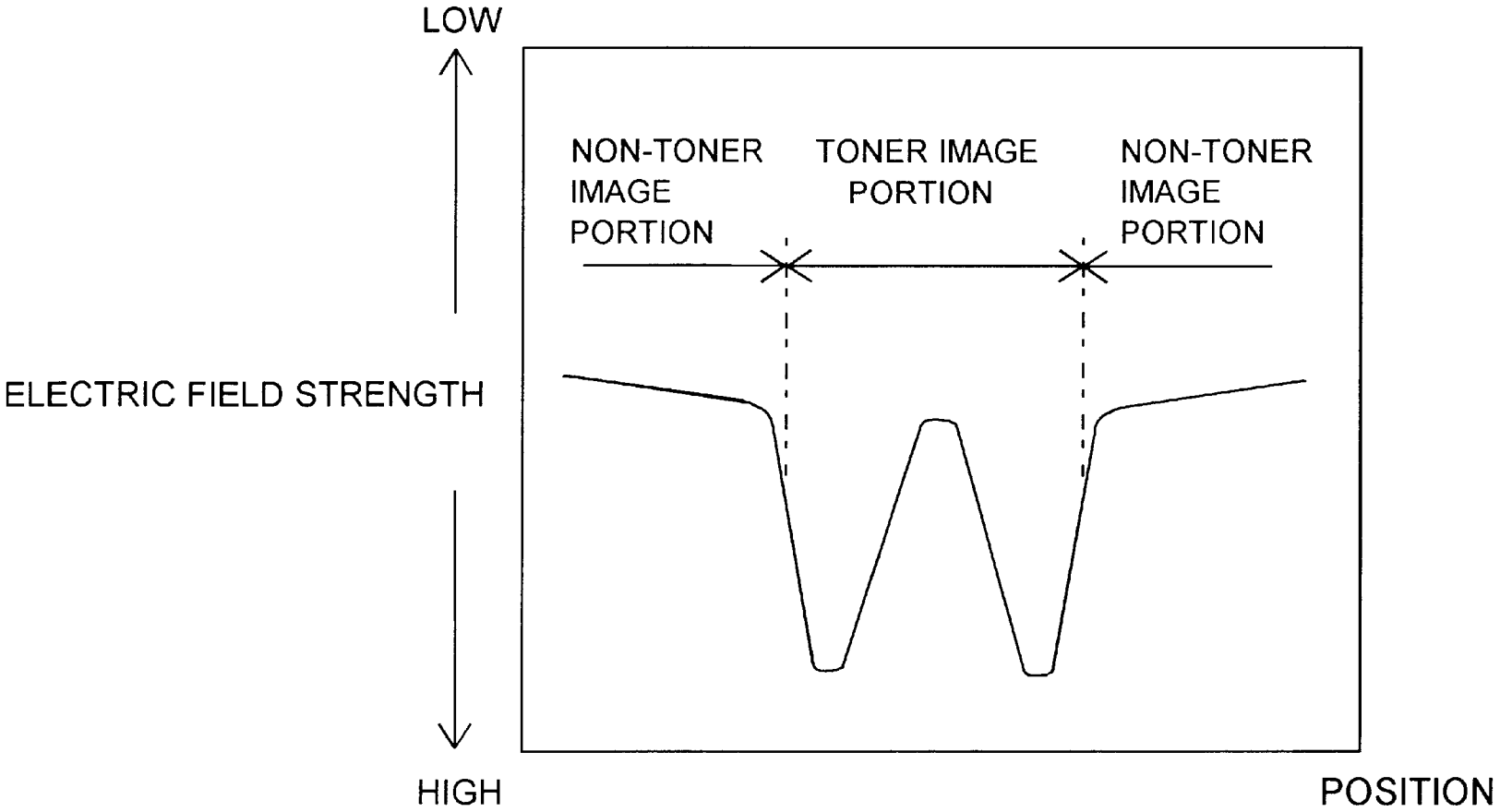
FIG. 15 is a graph relevant to a used photosensitive layer, showing the electric field distribution across the transfer zone having a narrow image pattern.
Figure 16:
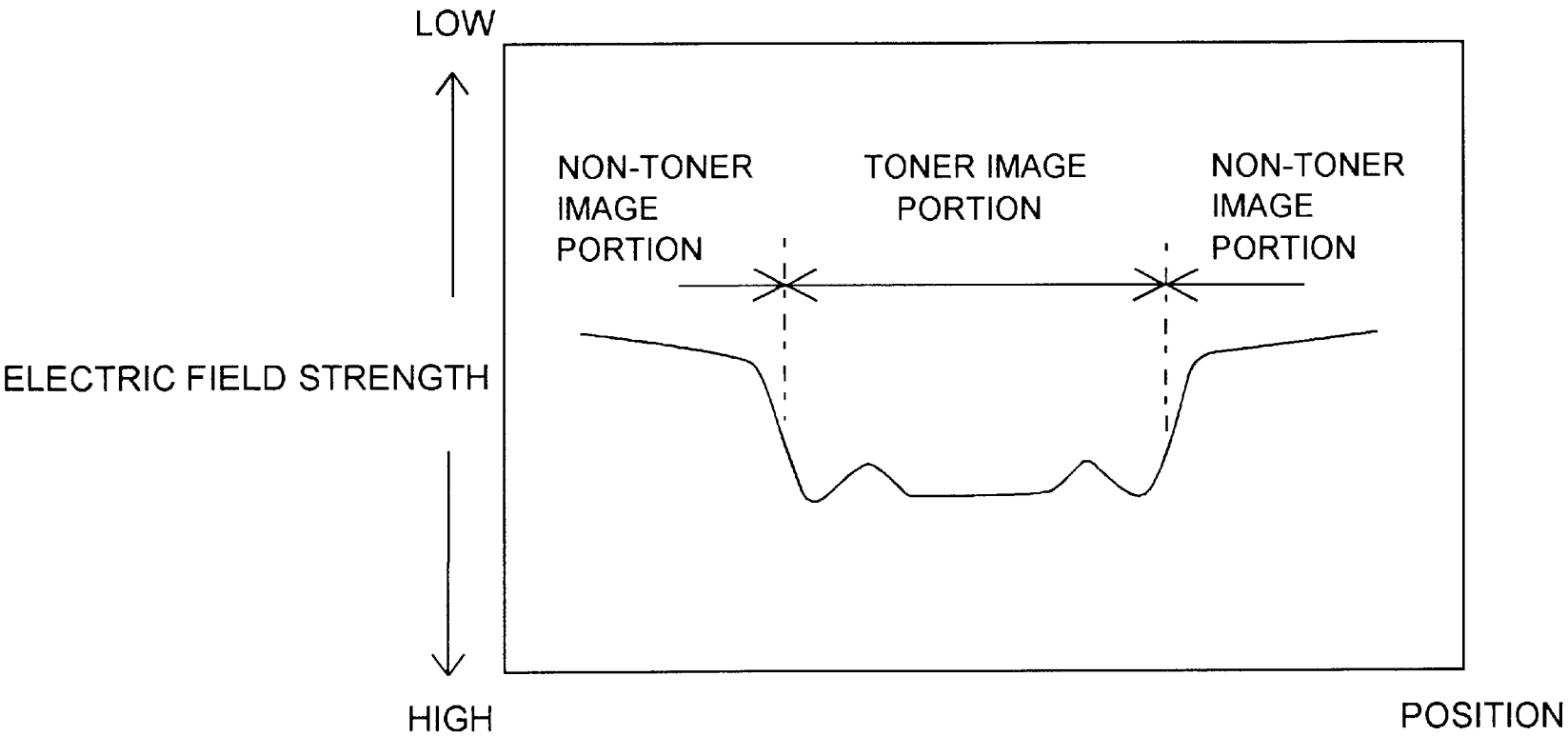
FIG. 16 is a graph relevant to a new photosensitive layer, showing the electric field distribution across the transfer zone having a wide image pattern.

As explained previously in connection with the conventional image forming apparatus with reference to FIGS. 12–15, the impedance of transfer zone (refer to FIG. 13) is represented by the equivalent circuit shown in FIG. 12, and the different impedances $Z_0$ and $Z_1$ of the toner image portion and non-toner image portion result in an uneven distribution of transfer electric field as shown in FIG. 14.

The image forming apparatus 1 of this embodiment having a new full-thickness photosensitive layer 12 initializes the transfer output so that the dropout does not occur even if the transfer brush 20 in contact with the transfer belt 26 is brought closest to the transfer zone (as shown by the filled image in FIG. 1).

When the photosensitive layer 12 wears thin due to the repeated use, the difference of $Z_0$ and $Z_1$ grows due to the decreased impedance $Z_T$ of the photosensitive layer 12, and the unevenness of electric field distribution across the transfer zone increases. Therefore, image formation in this state can possibly incur the dropout of image, and it cannot be overcome completely by the control of transfer output.

For coping with this matter, the image forming apparatus 1 is designed to increase the impedance $Z_B$ of the transfer belt 26 thereby to compensate the decreased impedance $Z_T$ of the photosensitive layer 12. For varying the impedance $Z_B$, the thickness of photosensitive layer 12 is measured and the contact position of the transfer brush 20 on the transfer belt 26 is varied in accordance with the measurement result.

The measurement of the thickness of photosensitive layer 12 is carried out as follows. Initially, the contact position of the transfer brush 20 on the transfer belt 26 is brought to the initial position (shown by the filled image in FIG. 1) if it is out of the position. The transfer belt 26 is operated to run idly to carry the print paper out of the transfer zone and remove residual toner.

Figure 2:
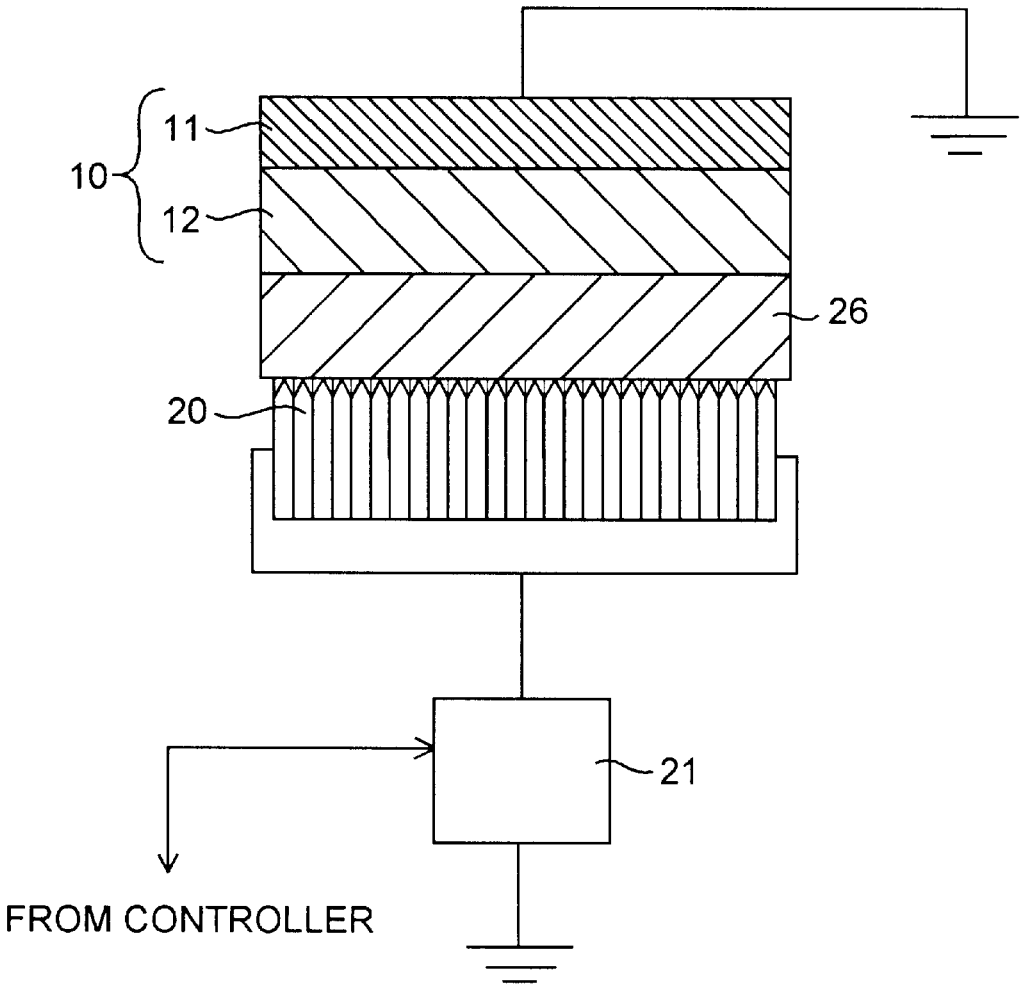
FIG. 2 is a diagram showing in a sense of model the measurement of the thickness of photosensitive layer by means of a transfer brush.

FIG. 2 shows, in a sense of model, the resulting state of the transfer zone, in which the photosensitive layer 12 and the transfer belt 26 are virtually in contact with each other. The transfer power source 21 is activated as constant voltage source so that a prescribed voltage is applied to the base cylinder 11, and the current flowing to the transfer belt 26 is measured. The voltage and the current are related by being dependent on the series impedance of the photosensitive layer 12, transfer belt 26 and transfer brush 20.

The transfer belt 26 and transfer brush 20 do not vary in their impedance during the long-term use, and accordingly the measured impedance is significant primarily in providing information on the thickness of the photosensitive layer 12. The measured thickness is indicated to the general controller 40.

The general controller 40 operates on the cam controller 42 to move the brush holder 30 thereby to vary the contact position of the transfer brush 20 on the transfer belt 26. The distance from the transfer zone to the contact position varies (increases), causing the impedance $Z_B$ of transfer belt 26 to contribute increasingly to the values of $Z_0$ and $Z_1$. Specifically, the ratio $Z_0/Z_1$ becomes closer to the initial value. Consequently, the unevenness of electric field distribution across the transfer zone is alleviated to become virtually the initial state (shown in FIG. 14), and image formation without the occurrence of dropout can be accomplished without incurring such a side effect of excessive transfer output as reverse (recurrent) transfer.

As an alternative scheme of the thickness measurement, the transfer power source 21 is used as constant current source and the applied voltage is measured.

Both impedances $Z_0$ and $Z_1$ of the transfer zone increase immediately after the contact position of the transfer brush 20 on the transfer belt 26 is varied, and therefore the transfer output needs to be increased in compensation.

As described above, the image forming apparatus 1 of this embodiment uses the transfer power source 21 and transfer brush 20 to get information on the thickness of photosensitive layer 12 and varies the contact position of the transfer brush 20 on the transfer belt 26 in accordance with the thickness information. Accordingly, even if the photosensitive layer 12 wears thin partially and has its impedance decreasing due to the long-term use, the apparatus can increase in compensation the impedance of the transfer belt 26 in its section from the transfer zone to the contact position of the transfer brush 20.

Accordingly, the apparatus can retain the difference of impedance between the toner image portion and non-toner image portion in the transfer zone and thus can retain the unevenness of transfer electric field distribution in the same degree as with a new photosensitive layer 12. Consequently, the apparatus can perform image formation without the occurrence of dropout and without incurring such a side effect of excessive transfer output by the control as reverse (recurrent) transfer in the long-term use. Thus, the inventive apparatus performs high-quality image formation without the occurrence of dropout throughout the operating life of the photosensitive layer 12.

In addition, for the acquisition of information on the thickness of photosensitive layer 12, the transfer power source 21 and transfer brush 20 are used, instead of providing additional component parts, so that the apparatus is prevented from becoming complex in structure and large in size. Based on the determination of the thickness of photosensitive layer 12 from the impedance between the base cylinder 11 and the transfer power source 21, the total impedance variation inclusive of other causes of impedance variation than the thickness of photosensitive layer 12 can be included in the control.

The foregoing embodiment does not impose any limitation on the present invention, but instead, various alterations and modifications are obviously possible without departing from the essence of the invention. For example, the disposition of the various devices around the photosensitive drum 10 is merely for the illustrative purpose. The transfer brush 20 may be replaced with a device of the sheet type or roller type.

Embodiment 2

Figure 3:
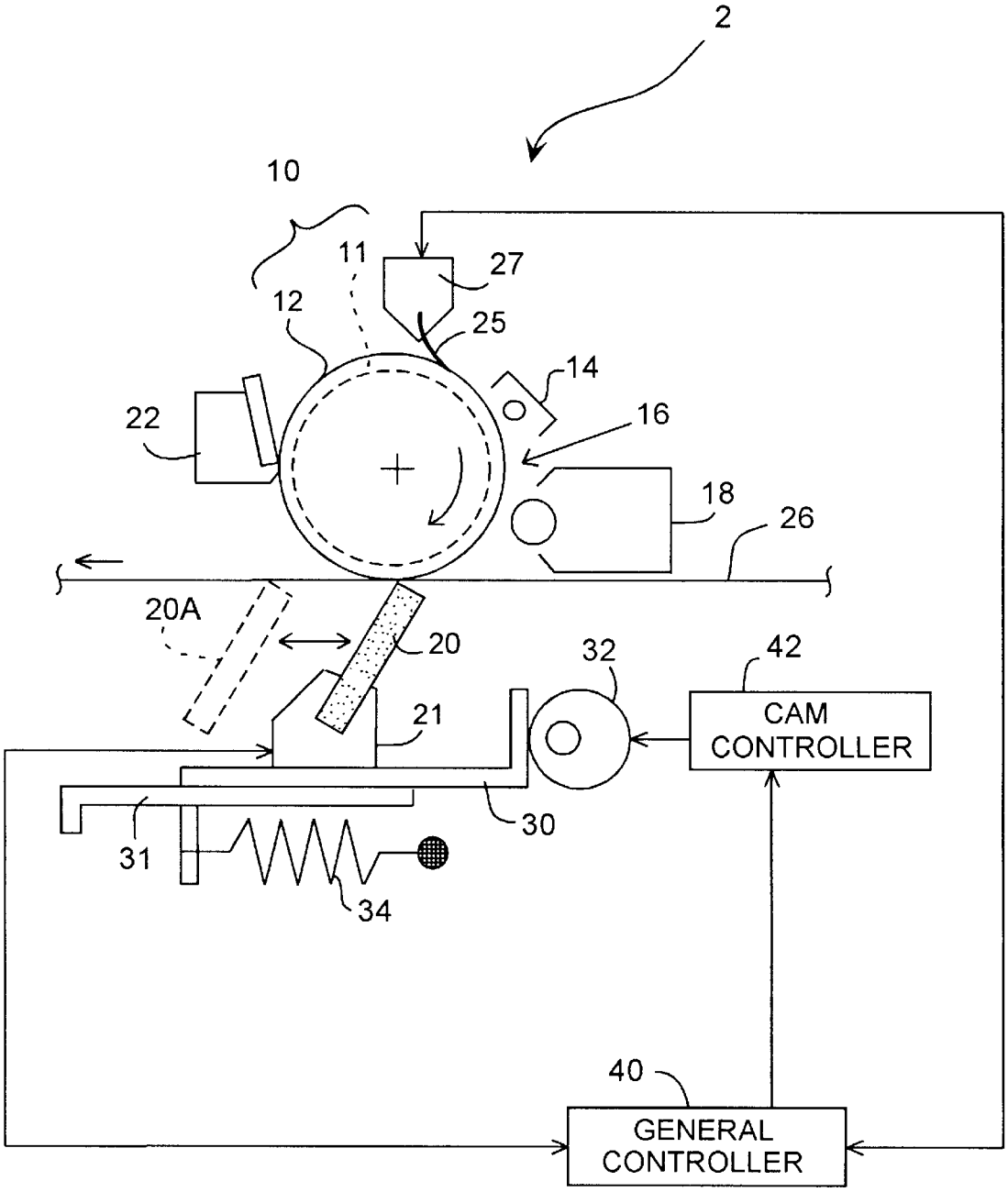
FIG. 3 is a schematic diagram showing the image forming apparatus based on a second embodiment of this invention.

FIG. 3 shows an image forming apparatus based on the second embodiment of this invention. This image forming apparatus 2 differs from the apparatus 1 of the first embodiment only in the adoption of a charging brush 25 of contact type for the charge eliminater. The charging brush 25 is connected by way of a charging power source 27 to the general controller 40 and controlled by it. The charging power source 27 can work either as a constant voltage source with a current metering function or a constant current source with a voltage metering function, as in the case of the transfer power source 21.

Figure 4:
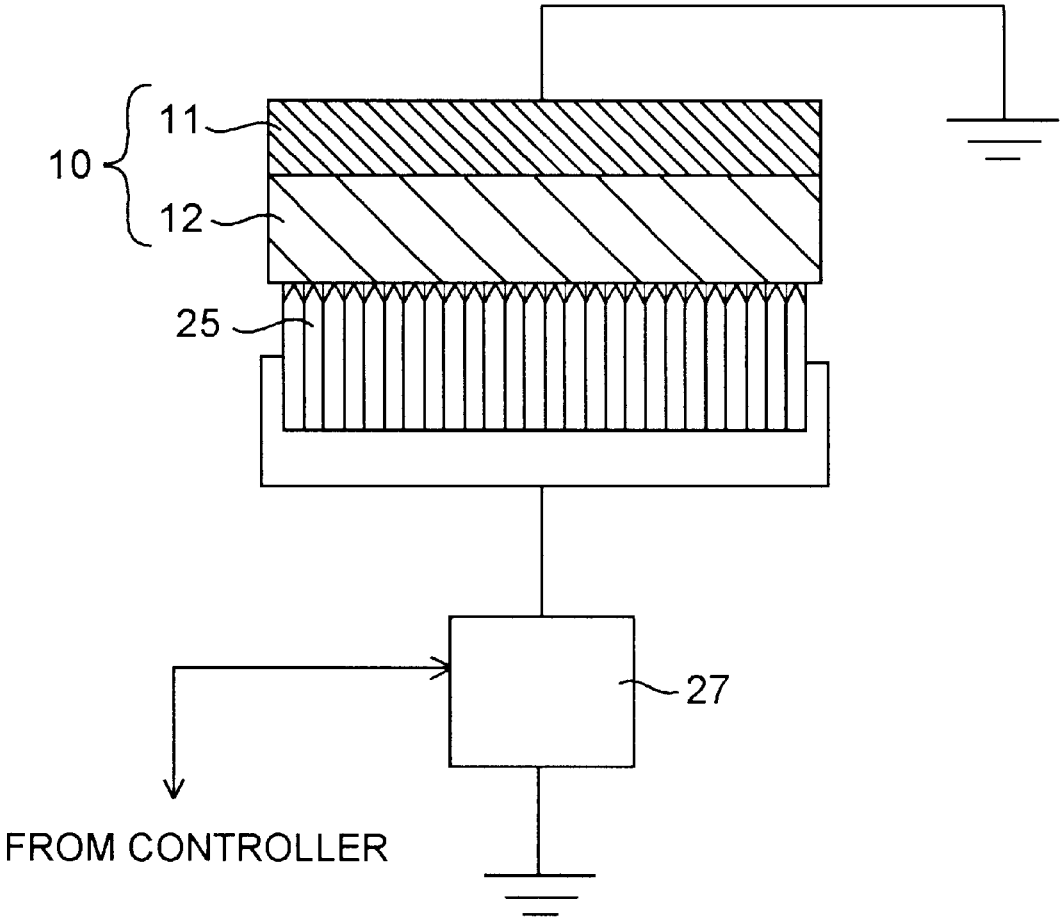
FIG. 4 is a diagram showing in a sense of model the measurement of the thickness of photosensitive layer by means of a charging brush.

FIG. 4 shows, in a sense of model, the contact position of the charging brush 25 on the photosensitive drum 10. The image forming operation is identical to the apparatus of the first embodiment.

The image forming apparatus 2 measures the thickness of the photosensitive layer 12 for the same purpose as the first embodiment, and controls the contact position of the transfer brush 20 on the transfer belt 26 based on the measurement result. The measurement of photosensitive layer 12 is carried out as follows. The photosensitive drum 10 is turned idly to clear residual toner and the like off the surface in advance. The charging power source 27 is activated as constant voltage source so that a prescribed voltage is applied to the base cylinder 11, and the current flowing to it is measured. The voltage and the current are related by being dependent on the series impedance of the charging brush 25 and photosensitive layer 12. The charging brush 25 does not vary in its impedance during the long-term use, and accordingly the measured impedance is significant primarily in providing information on the thickness of photosensitive layer 12. The measured value is indicated to the general controller 40.

The general controller 40 operates on the cam controller 42 to move the brush holder 30 thereby to vary the contact position of the transfer brush 20 on the transfer belt 26, as in the case of the first embodiment. Consequently, image formation without the occurrence of dropout can be accomplished without incurring such a side effect of excessive transfer output as reverse (recurrent) transfer.

As an alternative scheme of the thickness measurement, the charging power source 27 is used as constant current source and the applied voltage is measured.

Both impedances $Z_0$ and $Z_1$ of the transfer zone increase immediately after the contact position of the transfer brush 20 on the transfer belt 26 is varied, and therefore the transfer output needs to be increased in compensation.

As described above, the image forming apparatus 2 of this embodiment uses the charging power source 27 and charging brush 25 to get information on the thickness of photosensitive layer 12 and varies the contact position of the transfer brush 20 on the transfer belt 26 in accordance with the thickness information. Accordingly, even if the photosensitive layer 12 wears thin due to the long-term use, the apparatus can perform high-quality image formation without the occurrence of dropout and without incurring the side effect of the control.

In addition, for the acquisition of information on the thickness of photosensitive layer 12, the charging power source 27 and charging brush 25 are used, instead of providing additional component parts, so that the apparatus is prevented from becoming complex in structure and large in size.

Also for this embodiment, various alterations and modifications are possible without departing from the essence of the invention. For example, in place of the charger 14, a charging device of contact type similar to the charging brush 25 may be adopted, with its power source being used to get information on the thickness of photosensitive layer 12. Besides the charging brush 25, other possible types of charging device are sheet type and roller type.

Embodiment 3

Figure 5:
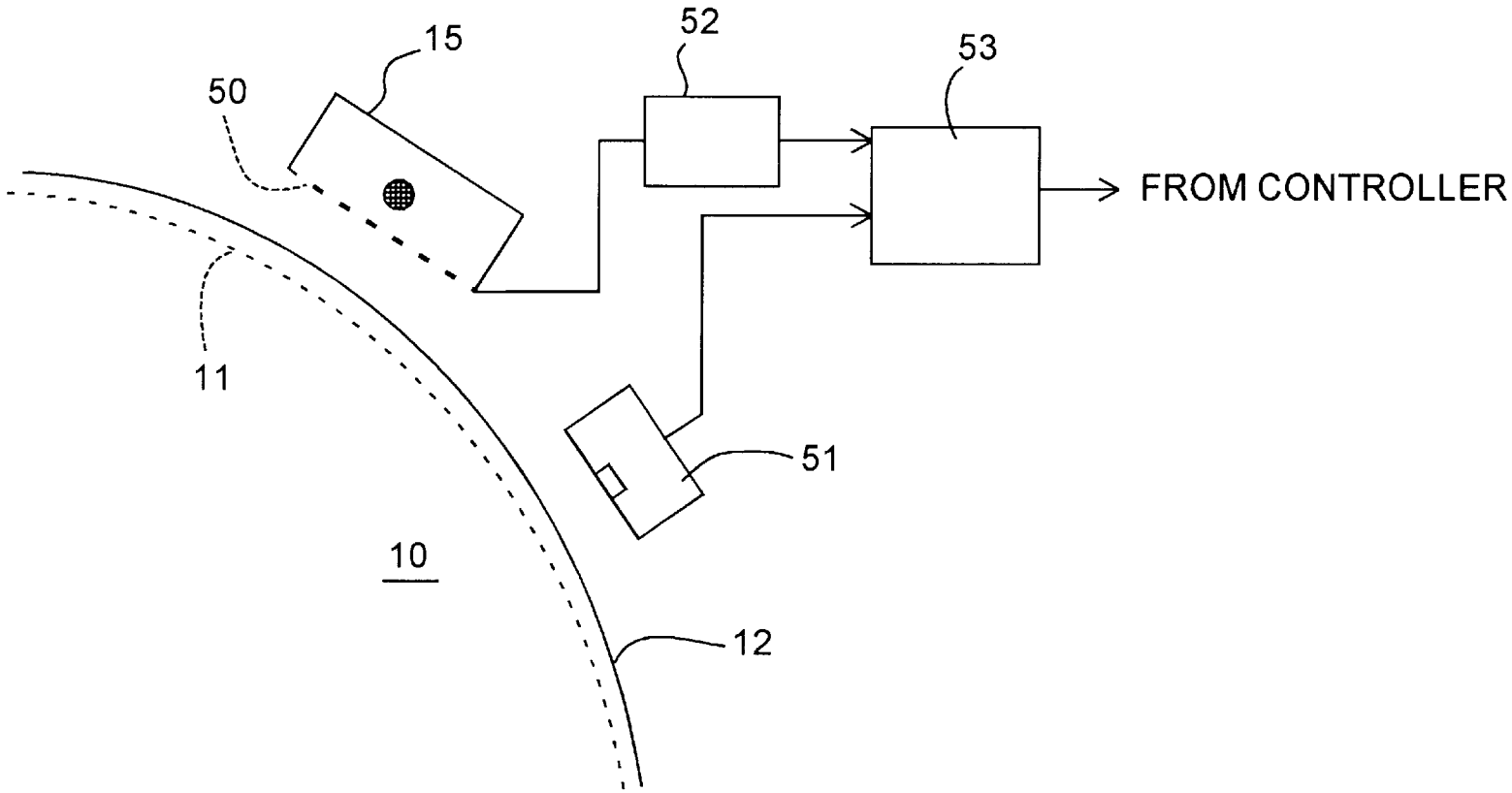
FIG. 5 is a schematic diagram showing the principal portion of the image forming apparatus based on a third embodiment of this invention.

FIG. 5 shows the principal portion of an image forming apparatus based on the third embodiment of this invention. The apparatus employs a Scorotron charger 15 for the charging device of the photosensitive layer 12 and a surface potential sensor 51 for detecting the potential of the photosensitive layer 12 charged by the Scorotron charger 15. The Scorotron charger 15 has the voltage on its grid 50 controlled by a grid voltage controller 52.

The thickness of the photosensitive layer 12 is calculated by a thickness calculation device 53 from a grid voltage value provided by the grid voltage controller 52 and a potential value provided by the surface potential sensor 51, and it is indicated to the general controller 40. The remaining structure is identical to the first embodiment.

The image forming apparatus measures the thickness of photosensitive layer 12 for the same purpose as the first embodiment, and controls the contact position of the transfer brush 20 on the transfer belt 26 based on the measurement result. The measurement of photosensitive layer 12 is carried out as follows. The photosensitive drum 10 is turned idly to clear residual toner and the like off the surface in advance. The grid voltage controller 52 is activated to apply a prescribed voltage to the Scorotron charger 15, while the photosensitive drum 10 is kept turning, and the surface potential sensor 51 detects the surface potential of the charged photosensitive layer 12.

The grid voltage and surface potential are related through the capacitance of the photosensitive layer 12, and the capacitance is dependent on the thickness. Based on this fact, the thickness calculation device 53 calculates the thickness of photosensitive layer 12, and indicates it to the general controller 40.

The general controller 40 operates on the cam controller 42 to move the brush holder 30 thereby to vary the contact position of the transfer brush 20 on the transfer belt 26, as in the case of the first embodiment. Consequently, image formation without the occurrence of dropout can be accomplished without incurring such a side effect of excessive transfer output as reverse (recurrent) transfer.

As an alternative scheme of the thickness measurement, the charging power source 27 is used as constant current source and the applied voltage is measured.

Both impedances $Z_0$ and $Z_1$ of the transfer zone increase immediately after the contact position of the transfer brush 20 on the transfer belt 26 is varied, and therefore the transfer output needs to be increased in compensation.

As described above, the image forming apparatus of this embodiment uses the Scorotron charger 15 and surface potential sensor 51 to get information on the thickness of photosensitive layer 12 and varies the contact position of the transfer brush 20 on the transfer belt 26 in accordance with the thickness information. Accordingly, even if the photosensitive layer 12 wears thin due to the long-term use, the apparatus can perform high-quality image formation without the occurrence of dropout and without incurring the side effect of the control.

Also for this embodiment, various alterations and modifications are possible obviously without departing from the essence of the invention.

Embodiment 4

The fourth embodiment of this invention is designed to provide the general controller 40 with a function of counting the number of times of image formation so that the thickness of photosensitive layer 12 is evaluated from the count. The correspondence between the number of times of image formation and the thickness of photosensitive layer is assessed as a function at the development stage of the apparatus.

In this embodiment, this function is stored as a ROM table in the general controller 40, and the value of thickness is read out of the ROM table based on the function and in response to the count of the number of times of image formation and used for the control of the cam controller 42.

The image forming apparatus based on this scheme is capable of performing high-quality image formation without the occurrence of dropout and without incurring the side effect even if the photosensitive layer 12 wears thin due to the long-term use, as in the case of the first embodiment.

Various alterations and modifications are possible obviously without departing from the essence of the invention.

Embodiment 5

Figure 6:
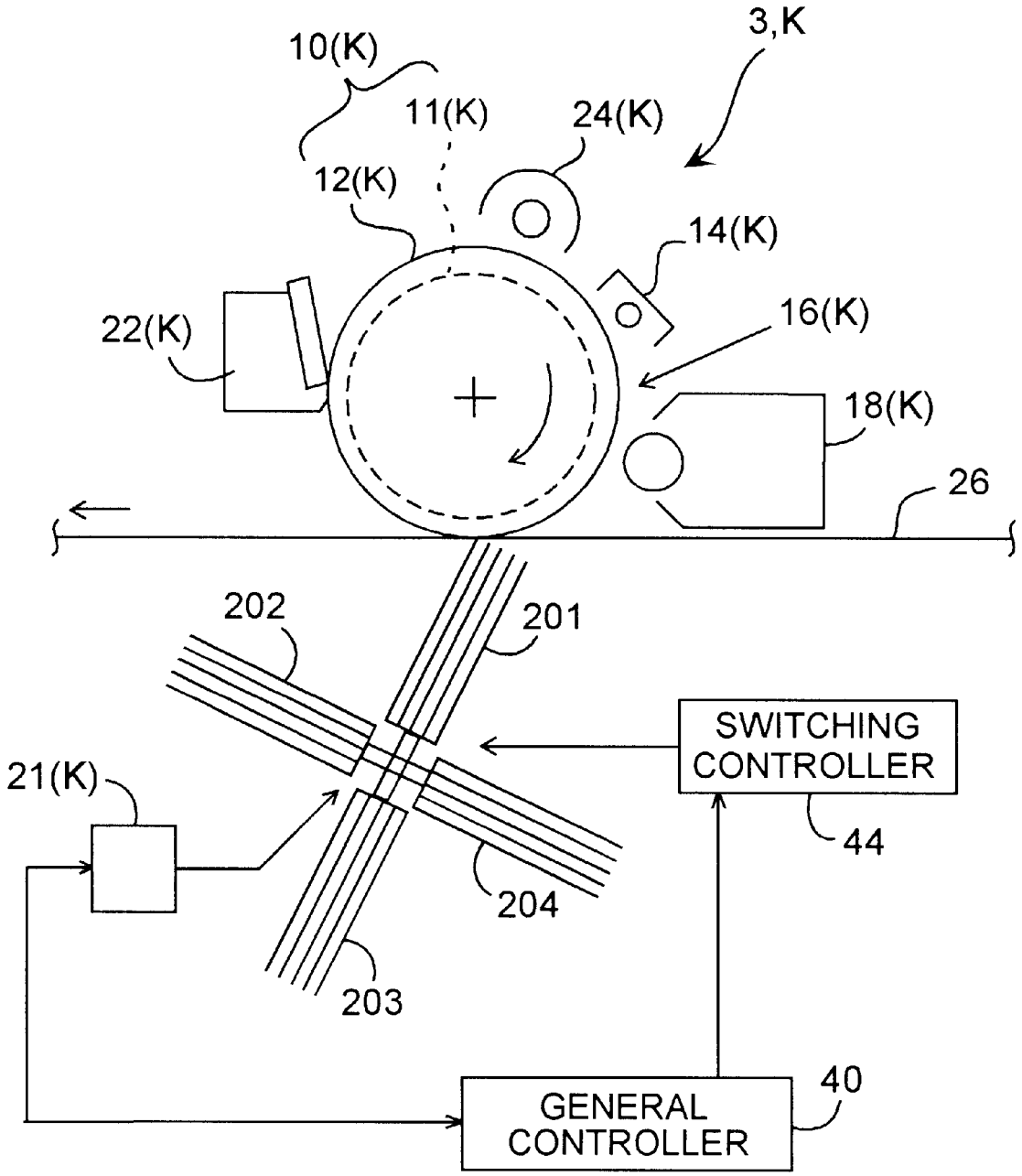
FIG. 6 is a schematic diagram showing the image forming apparatus based on a fifth embodiment of this invention.

FIG. 6 shows an image forming apparatus 3 based on the fifth embodiment of this invention. This image forming apparatus 3 differs from the apparatus 1 of the first embodiment in the provision of multiple transfer brushes 201–204 which are used selectively in place of the mechanism including the brush rail 31 and eccentric cam 32 which varies the contact position of the transfer brush 20 on the transfer belt 26. Among the transfer brushes 201–204 having different impedances, the transfer brush 201 has the smallest impedance. One of the transfer brushes 201–204 is brought in contact with the transfer belt 26 by a brush switching controller 44 in accordance with the command from the general controller 40.

The image forming apparatus 3, when it has a new photosensitive layer 12 with a sufficient thickness, initializes the brush switching controller 44 to select the transfer brush 201 with the smallest impedance. The remaining arrangement and operation are identical to the first embodiment.

The image forming apparatus 3 measures the thickness of the photosensitive layer 12 for the same purpose as the first embodiment, and implements the control of compensating the impedance of the transfer zone based on the measurement result. The thickness measurement is carried out as follows. Initially, the brush switching controller 44 restores the selection of the initial transfer brush 201 if it has been replaced with other. The transfer zone is cleared, and a constant voltage from the transfer power source 21 is applied and the current is measured to get information on the thickness of photosensitive layer 12, as in the case of the first embodiment. The measured thickness is indicated to the general controller 40.

The general controller 40 operates on the brush switching controller 44 to select one of the transfer brushes 201–204 that has the most suitable impedance for the measured thickness of the photosensitive layer 12. As a result, the impedance $Z_B$ of the section after the transfer belt 26 contributes increasingly to the values of $Z_0$ and $Z_1$, and the ratio $Z_0/Z_1$ becomes closer to the initial value.

Consequently, the unevenness of electric field distribution across the transfer zone is alleviated to the same degree as the initial state (shown in FIG. 14), and image formation without the occurrence of dropout can be accomplished without incurring such a side effect of excessive transfer output as reverse (recurrent) transfer.

As an alternative scheme of the thickness measurement, the transfer power source 21 is used as constant current source and the applied voltage is measured.

Both impedances $Z_0$ and $Z_1$ of the transfer zone increase immediately after the switching of transfer brush, and therefore the transfer output needs to be increased in compensation.

As described above, the image forming apparatus 3 of this embodiment uses the transfer power source 21 and transfer brush 201 to get information on the thickness of photosensitive layer 12 and control the switching of transfer brush based on the thickness information. Accordingly, even if the photosensitive layer 12 wears thin due to the long-term use, the apparatus can perform high-quality image formation without the occurrence of dropout and without incurring the side effect of the control, as in the case of the first embodiment.

Also for this embodiment, various alterations and modifications are possible without departing from the essence of the invention. For example, any number of transfer brushes, instead of four, can be used. The measurement of the thickness of photosensitive layer 12 may be implemented in the manner of the second or third embodiment, instead of using the transfer power source 21 and transfer brush 201.

Embodiment 6

Figure 7:
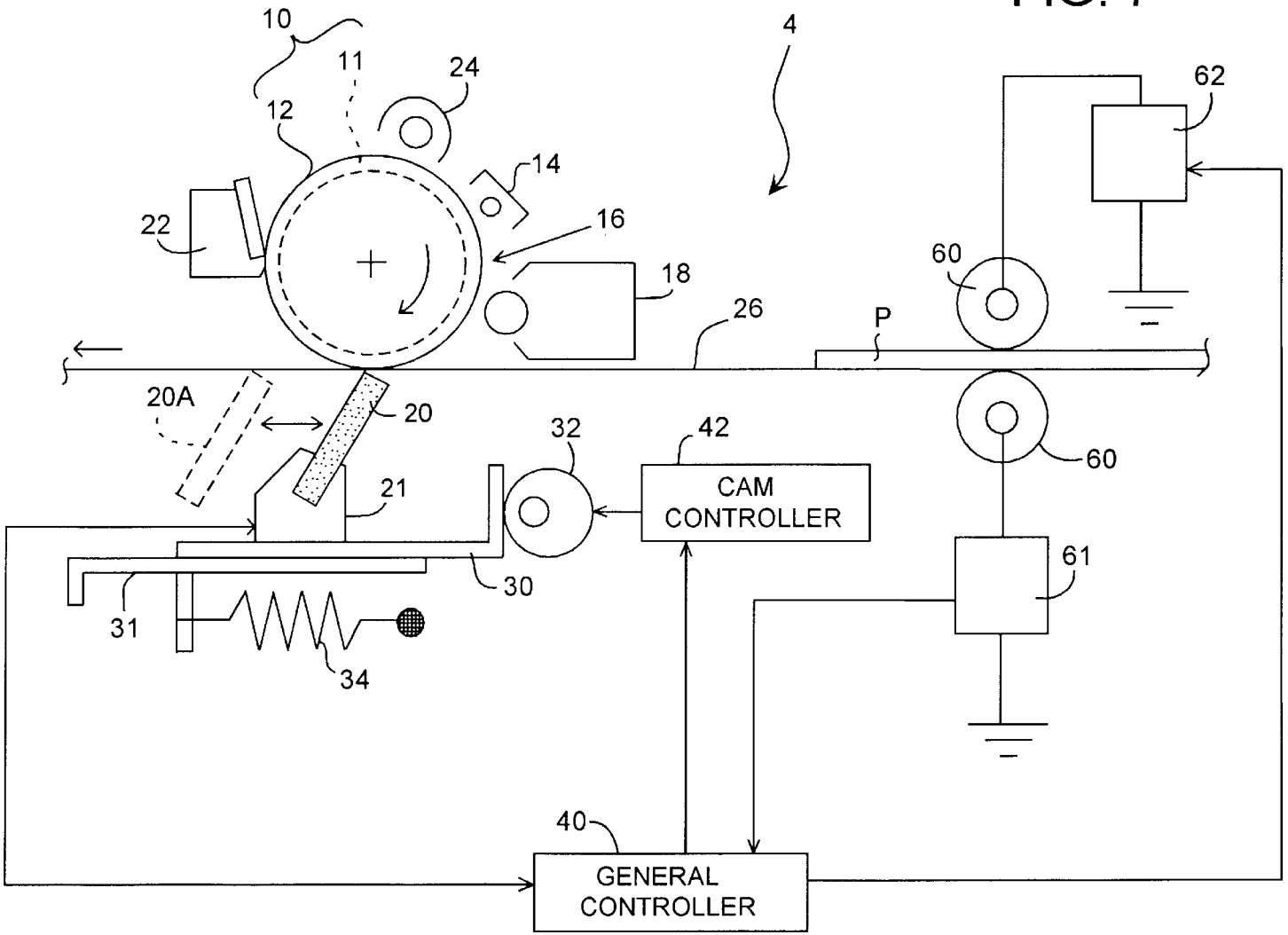
FIG. 7 is a schematic diagram showing the image forming apparatus based on a sixth embodiment of this invention.

FIG. 7 shows an image forming apparatus 4 based on the sixth embodiment of this invention. This apparatus is derived from the apparatus 1 of the first embodiment and provided additionally with a pair of thickness measuring rollers 60 located on the upstream side of the transfer zone to pinch the transfer belt 26, and an associated measuring power source 62 which applies a voltage to the rollers 60 and a current metering device 61. These additional devices operate in unison to measure the impedance of the print paper P which is carried by the transfer belt 26, so that the position of the transfer brush 20 is controlled based on the measurement result.

The image forming operation is identical to the first embodiment, and position control of the transfer brush 20 based on the measurement of the thickness of photosensitive layer 12 is also basically the same.

The image forming apparatus 4 controls the position of the transfer brush 20 not only based on the measured thickness of the photosensitive layer 12, but also based on the measured impedance of the print paper P. The impedances $Z_0$ and $Z_1$ of the transfer zone include the paper impedance $Z_P$, and a smaller value of $Z_P$ than normal incurs the same phenomenon of electric field distribution across the transfer zone as in the case of a decreased thickness of photosensitive layer 12, by which the dropout of image is liable to occur. This apparatus 4 is intended to cope with this matter.

The position control for the transfer brush 20 based on the measurement of paper impedance is carried out as follows. When the print paper P carried by the transfer belt 26 reaches the thickness measuring rollers 60, a prescribed voltage is applied between the rollers 60 by the measuring power source 62 in accordance with the command of the general controller 40. The current metering device 61 measures the current flowing through the rollers 60 and indicates it to the general controller 40. The general controller 40 calculates the impedance between the rollers 60 from the value of applied voltage provided by the measuring power source 62 and the value of current provided by the current metering device 61.

The calculated impedance is the series impedance of the impedance $Z_P$ of print paper P and impedance of transfer belt 26, of which the impedance of transfer belt 26 is known and does not virtually vary, and accordingly the paper impedance $Z_P$ can readily be extracted from the measured impedance.

The paper impedance $Z_P$ may be measured by supplying a prescribed current and measuring the voltage, instead of applying a prescribed voltage and measuring the current.

The general controller 40 operates on the cam controller 42 to vary the contact position of the transfer brush 20 on the transfer belt 26 based on the calculated paper impedance $Z_P$. The transfer brush 20 is moved in the same manner as the first embodiment. In case the paper impedance $Z_P$ is smaller than normal, the transfer brush 20 is moved to have its contact position on the transfer belt 26 shifted away from the transfer zone so that the brush impedance $Z_B$ increases. As a result, the unevenness of electric field distribution across the transfer zone is retained virtually the same as the case of the normal paper impedance $Z_P$, and the dropout of image scarcely occurs.

The impedance measurement and movement control of transfer brush 20 are carried out for each sheet of print paper, so that image formation takes place at the optimal position of transfer brush 20 individually for each kind of print paper. In addition, the apparatus can deal with the variation of impedance among sheets of print paper of the same kind attributable to such an environmental factor as the humidity.

As described above, the image forming apparatus 4 of this embodiment uses the thickness measuring rollers 60, measuring power source 62 and current metering device 61 to measure the impedance of print paper P and controls the contact position of the transfer brush 20 on the transfer belt 26 based on the measurement result. Accordingly, the apparatus can cope with the variation of paper impedance attributable to the kind of print paper or the environment by varying the impedance of the transfer belt 26 in its section from the transfer zone to the contact position on the transfer brush 20.

Consequently, image formation without the occurrence of dropout can be accomplished without incurring such a side effect of excessive transfer output as reverse (recurrent) transfer irrespective of the kind of print paper and the environment. Based on the measurement of paper impedance on the upstream side of the transfer zone, the apparatus implements the impedance control individually to meet even a successive feed of print paper of different kinds, thereby printing images without the dropout.

The foregoing embodiment does not impose any limitation on the present invention, but instead, various alterations and modifications are obviously possible without departing from the essence of the invention. For example, the disposition of the various devices around the photosensitive drum 10 is merely for the illustrative purpose. The transfer brush 20 may be replaced with a device of sheet type or roller type, as mentioned previously in connection with the first embodiment. The cam-based brush moving mechanism may be replaced with a mechanism of multiple transfer brushes as employed in the fourth embodiment. The scheme of thickness measurement for the photosensitive layer 12 may be replaced with the scheme of the second embodiment or fourth embodiment.

Embodiment 7

Figure 8:
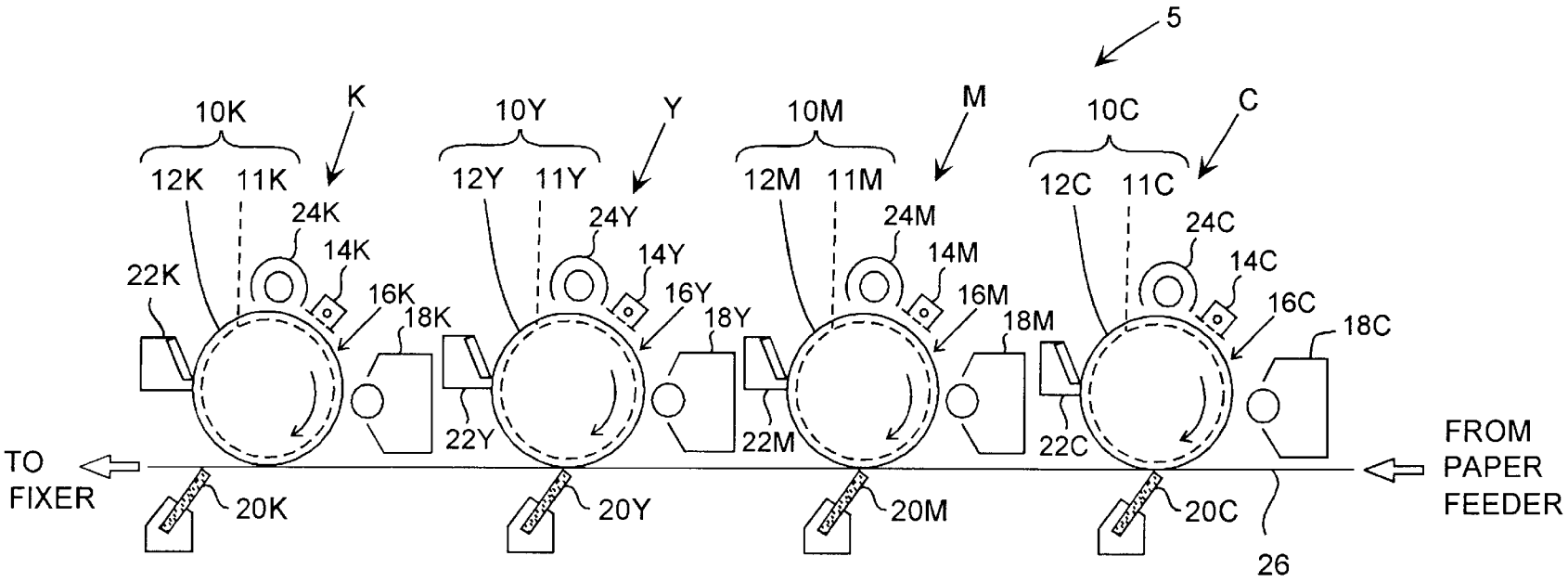
FIG. 8 is a schematic diagram showing the image forming apparatus based on a seventh embodiment of this invention.

FIG. 8 shows the principal portion of an image forming apparatus 5 based on the eighth embodiment of this invention. The apparatus 5 includes image forming units C, M, Y and B for four colors of cyanine, magenta, yellow and black disposed tandem in this order in the paper feed direction along the endless belt 26 which bears and transports a sheet of print paper.

The image forming unit K for black color includes a photosensitive drum 10K which consists of a base cylinder 11K and a photosensitive layer 12K formed on it, and a charger 14K, a light exposure device 16K, a developer 18K, a transfer brush 20K, a cleaner 22K and a charge eliminater 24K all disposed to surround the photosensitive drum 10K. The carrying belt 26 is arranged to run through the gap between the photosensitive drum 10K and the transfer brush 20K.

The transfer brush 20K is equipped with the same moving device as used in the first embodiment shown in FIG. 1. Specifically, on the rear side of the carrying belt 26 (nearer to the transfer brush 20K), there are disposed a brush rail 31 on which the transfer brush 20K can move, a brush holder 30K and a transfer power source 21K.

The unit K further includes an eccentric cam 32 and an extension spring 34, so that the contact position of the transfer brush 20K on the carrying belt 26 can be varied. The transfer brush 20K shown as a filled image in FIG. 1 is located at the position where the photosensitive drum 10K and the carrying belt 26 are closest to each other, whereas the transfer brush 20A shown as a dashed-line image is located with some distance from that position and in this state the impedance of the carrying belt 26 in its section from the position closest to the photosensitive drum 10K, i.e., transfer zone, to the position of contact with the transfer brush 20K differs from those of image forming units of other colors.

The transfer power source 21K can work either as a constant voltage source with a current metering function or a constant current source with a voltage metering function.

The image forming apparatus 5 has control systems directed by a general controller 40 and cam controller 42.

The remaining image forming units C, M and Y have the same arrangement as the unit K for black color, except that these units do not have a brush moving mechanism such as the eccentric cam 32.

The basic image forming operation of the image forming apparatus 5 is as follows. The photosensitive drums 10C, 10M,10Y and 10K (will be termed generically photosensitive drum 10) are turned in the clockwise direction on the drawing at a constant surface speed, and the carrying belt 26, on which (the upper side nearer to the photosensitive drums 10) a sheet of print paper is borne, runs by being synchronized with the drum surface speed.

The charger 14 associated with each turning photosensitive drum 10 is activated to charge the photosensitive layer 12 of the drum to have a prescribed potential and the exposure device 16 is activated to emit a laser beam, which is modulated by image data, to the photosensitive layer 12 so that a static latent image is formed on it. Laser beam emission by the individual exposure devices 16 is synthesized with the movement of print paper on the carrying belt 26. Toner of each color, which is charged negatively by each developer 18, is put to the static latent image, and the latent image is converted into a toner image of that color.

During the image forming process, the carrying belt 26 is charged positively on its rear side by each transfer brush 20, and an electric field is generated in each transfer zone. When the toner image of each color on the photosensitive layer 12 reaches the transfer zone, toner is attracted by the electric field and the toner image is transferred to the print paper. Accordingly, the toner images of all colors of C, M, Y and K are transferred to the print paper one by one in the respective transfer zones, so that toner images of all colors are superimposed on the print paper.

The print paper, with the toner images being transferred thereto, is further carried by the carrying belt 26 to the fixer, by which the superimposed toner images are rendered the heat treatment for fixing, and a colored image is printed on the print paper. These operations are conducted by the general controller 40.

Besides the foregoing basic operation, the image forming apparatus 5 implements the control for varying the contact position of the transfer brush 20K of black color on the carrying belt 26 in the same manner as the first embodiment. Specifically, when a new photosensitive layer 12K has a sufficient thickness, the transfer output is initialized so that the dropout of image does not occur even if the contact position of the transfer brush 20K on the carrying belt 26 is brought closest to the transfer zone (shown by the filled image in FIG. 1).

When the photosensitive layer 12K wears thin due to the repeated use, image formation in this state can possibly incur the dropout, and it cannot be overcome completely by the control of transfer output. Moreover, black color (K) is used overwhelmingly more than other colors of C, M and Y, and it is most influential on the appearance of printed image at the occurrence of dropout.

For dealing with this matter, the image forming apparatus 5 is designed to increase the impedance $Z_B$ of the carrying belt 26 thereby to offset the reduction of the impedance $Z_T$ of photosensitive layer 12K by measuring the thickness of photosensitive layer 12K and varying the contact position of the transfer brush 20K on the carrying belt 26 based on the measurement result.

The measurement of the thickness of photosensitive layer 12K is carried out in the same manner as the first embodiment. Specifically, the transfer brush 20K is brought to the initial position, and the transfer belt 26 is operated to run idly to carry the print paper out of the drum train. The transfer power source 21K is activated as constant voltage source and the output current is measured, or alternatively the power source 21K is activated as constant current source and the voltage is measured. The measured impedance of the photosensitive layer 12K is indicated to the general controller 40.

The general controller 40 operates on the cam controller 42 to vary the contact position of the transfer brush 20K so that image formation without the occurrence of dropout is accomplished without incurring such a side effect of excessive transfer output as reverse (recurrent) transfer. Both impedances $Z_0$ and $Z_1$ of the transfer zone increase immediately after the contact position of the transfer brush 20 on the transfer belt 26 is varied, and therefore the transfer output needs to be increased in compensation.

Besides the foregoing control based on the thickness of photosensitive layer 12K, the image forming apparatus 5 implements the control for varying the contact position of the transfer brush 20K on the carrying belt 26 based on the impedance between the top and rear sides of print paper on the carrying belt 26. Namely, the impedance between the top and rear sides of print paper differs depending on the kind of paper and is affected by the environment (particularly the humidity), and it is intended to prevent the emergence of the same problem caused by a reduced impedance of a thinner photosensitive layer 12K during the long-term use.

The image forming apparatus 5 initializes the transfer output so that when the impedance between the top and rear sides of print paper is large enough, the dropout of image does not occur even if the contact position of the transfer brush 20K on the carrying belt 26 is brought closest to the transfer zone.

In case the impedance $Z_P$ between the top and rear sides of print paper on the carrying belt 26 is small, the difference of $Z_0$ and $Z_1$ will expand, resulting in an aggravated unevenness of electric field distribution across the transfer zone. Image formation in this state will possibly incur the dropout, and it cannot be overcome completely by the control of transfer output. Moreover, black color is most influential on the print quality among the four colors of C, M, Y and K, as mentioned previously.

For dealing with this matter, the image forming apparatus 5 is designed to increase the impedance $Z_B$ of the carrying belt 26 thereby to offset the reduction of paper impedance $Z_P$ by measuring the impedance $Z_P$ between the top and rear sides of print paper and varying the contact position of the transfer brush 20K on the carrying belt 26 based on the measurement result.

Figure 9:
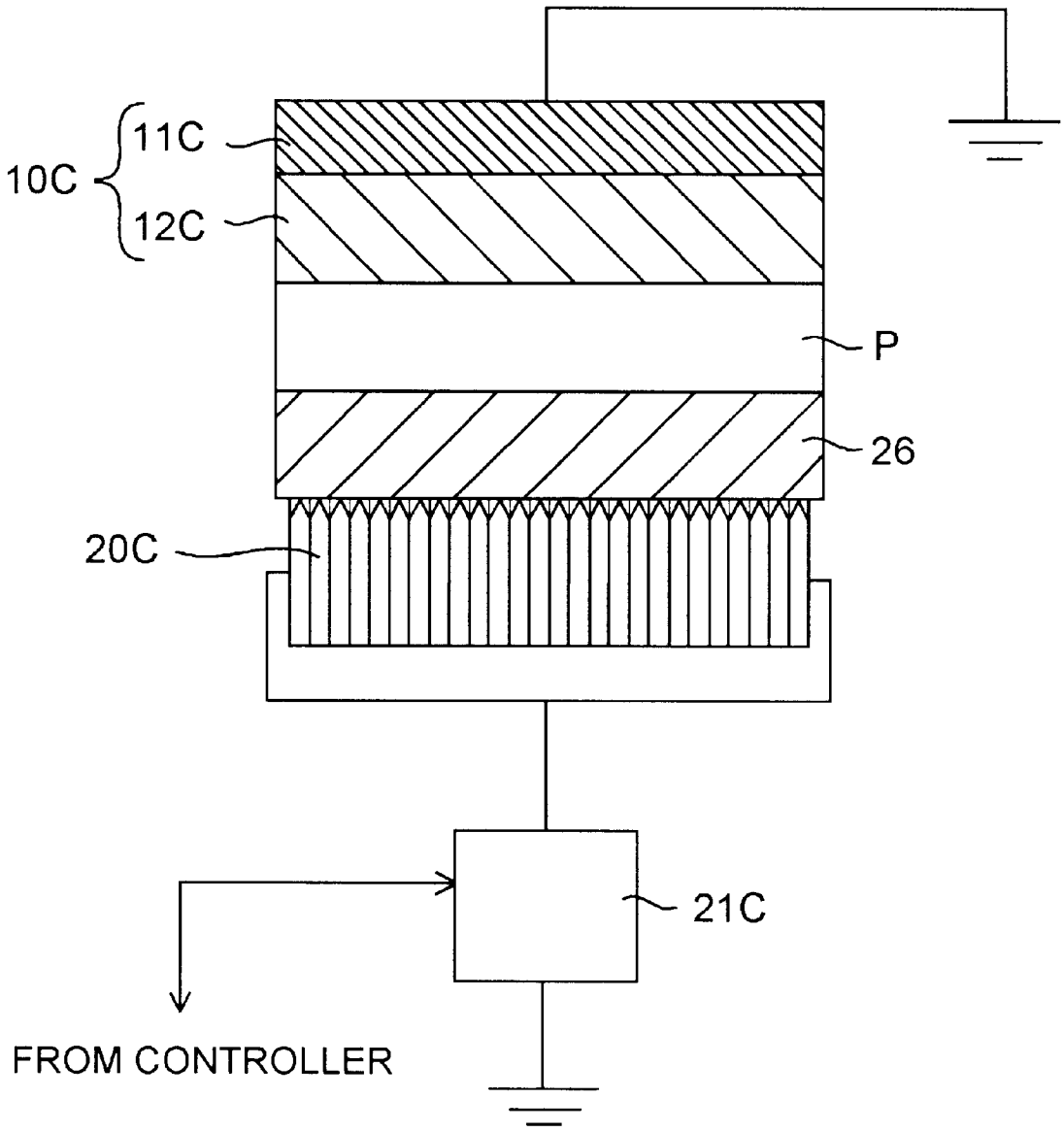
FIG. 9 is a diagram showing in a sense of model the measurement of the impedance of print paper.

The measurement of the paper impedance $Z_P$ is implemented by the image forming unit C of cyanine color that is located at the most upstream position among the four image forming units and in the paper area where the cyanine toner image is absent. It takes place as follows. When the print paper P carried by the carrying belt 26 reaches the image forming unit C of cyanine color, the transfer power source 21C is activated as constant voltage source and the output current is measured, or alternatively the power source 21C is activated as constant current source and the voltage is measured (refer to FIG. 9).

The voltage and the current are related by being dependent on the series impedance of the photosensitive layer 12C, print paper P, carrying belt 26 and transfer brush 20C. Among these parts, the photosensitive layer 12C, carrying belt 26 and transfer brush 20C do not vary in their impedance, and accordingly the measurement result mainly bears information on the impedance between the top and rear sides of print paper. The impedance of photosensitive layer 12C which varies during the long-term use is measured in advance. The measured paper impedance is indicated to the general controller 40.

In case the paper impedance $Z_P$ is smaller than normal, the general controller 40 activates the cam controller 42 of the image forming unit K of black color to vary the contact position of the transfer brush 20K. As a result, the distance from the transfer zone to the contact position varies (increases), causing the impedance $Z_B$ of carrying belt 26 to contribute increasingly to the values of $Z_0$ and $Z_1$. Specifically, the ratio $Z_0/Z_l$ becomes closer to the normal value. Consequently, the unevenness of electric field distribution across the transfer zone is alleviated to become virtually the normal state (shown in FIG. 14), and image formation without the occurrence of dropout can be accomplished without incurring such a side effect of excessive transfer output as reverse (recurrent) transfer. Both impedances $Z_0$ and $Z_1$ of the transfer zone increase immediately after the contact position of the transfer brush 20K on the carrying belt 26 is varied, and therefore the transfer output needs to be increased in compensation.

As described above in detail, the image forming apparatus 5 of this embodiment uses the transfer power source 21K and transfer brush 20K of the image forming unit K of black color, which is used most in quantity and is most crucial for the print quality, to get information on the thickness of photosensitive layer 12K, and controls the contact position of the transfer brush 20K on the carrying belt 26. Accordingly, even if the photosensitive layer 12K wears thin and has its impedance reduced due to the long-term use, it can be offset by increasing in compensation the impedance of the carrying belt 26 in its section from the transfer zone to the contact position of the transfer brush 20K.

Accordingly, the apparatus can retain the difference of impedance between the toner image portion and non-toner image portion in the transfer zone and thus can retain the unevenness of transfer electric field distribution in the same degree as with a new photosensitive layer 12K. Consequently, the apparatus can perform image formation without the occurrence of dropout and without incurring such a side effect of excessive transfer output by the control as reverse (recurrent) transfer in the long-term use. Thus, the inventive apparatus performs high-quality image formation without the occurrence of dropout throughout the operating life of the photosensitive layer 12K.

In addition, for the acquisition of information on the thickness of photosensitive layer 12K, the transfer power source 21K and transfer brush 20K are used, instead of providing additional component parts, so that the apparatus is prevented from becoming complex in structure and large in size. Based on the determination of the thickness of photosensitive layer 12K from the impedance between the base cylinder 11K and the transfer power source 21K, the total impedance variation inclusive of other causes of impedance variation than the thickness of photosensitive layer 12K can be included in the control.

Furthermore, the image forming apparatus 5 measures the impedance $Z_P$ between the top and rear sides of print paper and controls the most crucial image forming unit K of black color to have the contact position of the transfer brush 20K on the carrying belt 26 based on the measurement result. Accordingly, even if the print paper has a smaller impedance due to the kind of paper or the environment, it can be offset by increasing in compensation the impedance of the carrying belt 26 in its section from the transfer zone to the contact position of the transfer brush 20K.

Accordingly, the apparatus can retain the difference of impedance between the toner image portion and non-toner image portion in the transfer zone and thus can retain the unevenness of transfer electric field distribution in the same degree as in the normal state. Consequently, the apparatus can perform image formation without the occurrence of dropout and without incurring such a side effect of excessive transfer output by the control as reverse (recurrent) transfer even for print paper having a small impedance. Thus, the inventive apparatus performs high-quality image formation without the occurrence of dropout irrespective of the physical state of print paper.

The measurement of the paper impedance $Z_P$ is implemented by using the transfer power source 21C and transfer brush 20C of the image forming unit C of cyanine color that is located at the upstream side of the unit of black color, instead of providing additional component parts, so that the apparatus is prevented from becoming complex in structure and large in size. Based on the measurement of paper impedance $Z_P$ for each sheet of print paper for the determination of the position of transfer brush 20K, the apparatus implements the optimal position control of the transfer brush 20K to meet even a successive feed of print paper of different kinds.

The foregoing embodiment does not impose any limitation on the present invention, but instead, various alterations and modifications are obviously possible without departing from the essence of the invention. For example, the disposition of the various devices around the photosensitive drums 10 is merely for the illustrative purpose. Each transfer brush 20 may be replaced with a device of sheet type or roller type. The measurement of the impedance $Z_P$ between the top and rear sides of print paper may be implemented by any image forming unit located on the upstream side of the unit of black color, instead of the unit C of cyanine color. The position control of the transfer brush may be implemented for other color instead of black color. At the expense of a slightly increased number of component parts, independent sensors for measuring the thickness of photosensitive layer 12K and the impedance of print paper may be provided.

Embodiment 8

An image forming apparatus based on the eighth embodiment of this invention is derived from the seventh embodiment, with its mechanism (brush rail 31, eccentric cam 32, etc.) for moving the transfer brush 20K being replaced with the switching mechanism for multiple transfer brushes used in the fifth embodiment. Namely, the apparatus includes multiple transfer brushes 210–204, as shown in FIG. 6, which have different impedance values and are used selectively.

Among the transfer brushes 201–204, of which the transfer brush 201 has the smallest impedance, one is brought in contact with the transfer belt 26 by the brush switching controller 44 in accordance with the command from the general controller 40. The apparatus, when it has a new photosensitive layer 12K with a sufficient thickness, initializes the brush switching controller 44 to select the transfer brush 201 having the smallest impedance. The remaining arrangement and operation are identical to the seventh embodiment.

The image forming apparatus measures the thickness of the photosensitive layer 12K for the same purpose as the seventh embodiment, and implements the control of compensating the impedance of the transfer zone based on the measurement result. The thickness measurement is carried out as follows. Initially, the selection of the initial transfer brush 201 is restored if it has been replaced with other. The transfer zone is cleared, and a constant voltage from the transfer power source 21K is applied and the current is measured, or alternatively a prescribed current is supplied and the voltage is measured, to get information on the thickness of photosensitive layer 12K, as in the case of the seventh embodiment. The measured thickness is indicated to the general controller 40.

The general controller 40 operates on the brush switching controller 44 to select one of the transfer brushes 201–204 having the most suitable impedance for the measured thickness of the photosensitive layer 12K. Consequently, image formation without the occurrence of dropout can be accomplished without incurring such a side effect of excessive transfer output as reverse (recurrent) transfer. Both impedances $Z_0$ and $Z_1$ of the transfer zone increase immediately after the switching of transfer brush, and therefore the transfer output needs to be increased in compensation.

The control based on the impedance between the top and rear sides of print paper on the carrying belt 26 is implemented in virtually the same manner as the seventh embodiment. Specifically, the paper impedance $Z_P$ is measured in the same manner as the seventh embodiment, and it is indicated to the general controller 40. In case the impedance $Z_P$ is smaller than normal, the general controller 40 operates on the brush switching controller 44 in the image forming unit K of black color to select one of the transfer brushes 201–204, so that the impedance of the section after the transfer belt 26 matches with the measured paper impedance $Z_P$. Consequently, normal image formation without the occurrence of dropout can be accomplished without incurring such a side effect of excessive transfer output as reverse (recurrent) transfer.

As described above, the image forming apparatus of this embodiment uses the transfer power source 21K and transfer brush 201 in the image forming unit K of black color, which is used most in quantity and is most crucial for the print quality, to get information on the thickness of photosensitive layer 12K, and controls the switching of transfer brush. Accordingly, even if the photosensitive layer 12K wears thin partially and has its impedance reduced due to the long-term use, it can be offset by increasing the impedance of transfer brush in compensation.

Accordingly, the apparatus can retain the difference of impedance between the toner image portion and non-toner image portion in the transfer zone and thus can retain the unevenness of transfer electric field distribution in the same degree as with a new photosensitive layer 12K. Consequently, the apparatus can perform image formation without the occurrence of dropout and without incurring such a side effect of excessive transfer output by the control as reverse (recurrent) transfer in the long-term use. Thus, the inventive apparatus performs high-quality image formation without the occurrence of dropout throughout the operating life of the photosensitive layer 12K.

Furthermore, the apparatus measures the impedance $Z_P$ between the top and rear sides of print paper and control the switching of transfer brush in the most crucial image forming unit K of black color based on the measurement result. Accordingly, even if the print paper has a smaller impedance due to the kind of paper or the environment, it can be offset by increasing the impedance of transfer brush in compensation.

Accordingly, the apparatus can retain the difference of impedance between the toner image portion and non-toner image portion in the transfer zone and thus can retain the unevenness of transfer electric field distribution in the same degree as in the normal state. Consequently, the apparatus can perform image formation without the occurrence of dropout and without incurring such a side effect of excessive transfer output by the control as reverse (recurrent) transfer even for print paper having a small impedance. Thus, the inventive apparatus performs high-quality image formation without the occurrence of dropout irrespective of the physical state of print paper.

The foregoing embodiment does not impose any limitation on the present invention, but instead, various alterations and modifications are obviously possible without departing from the essence of the invention. For example, the variants explained in connection with the first embodiment are also relevant to this embodiment.

Embodiment 9

Figure 10:
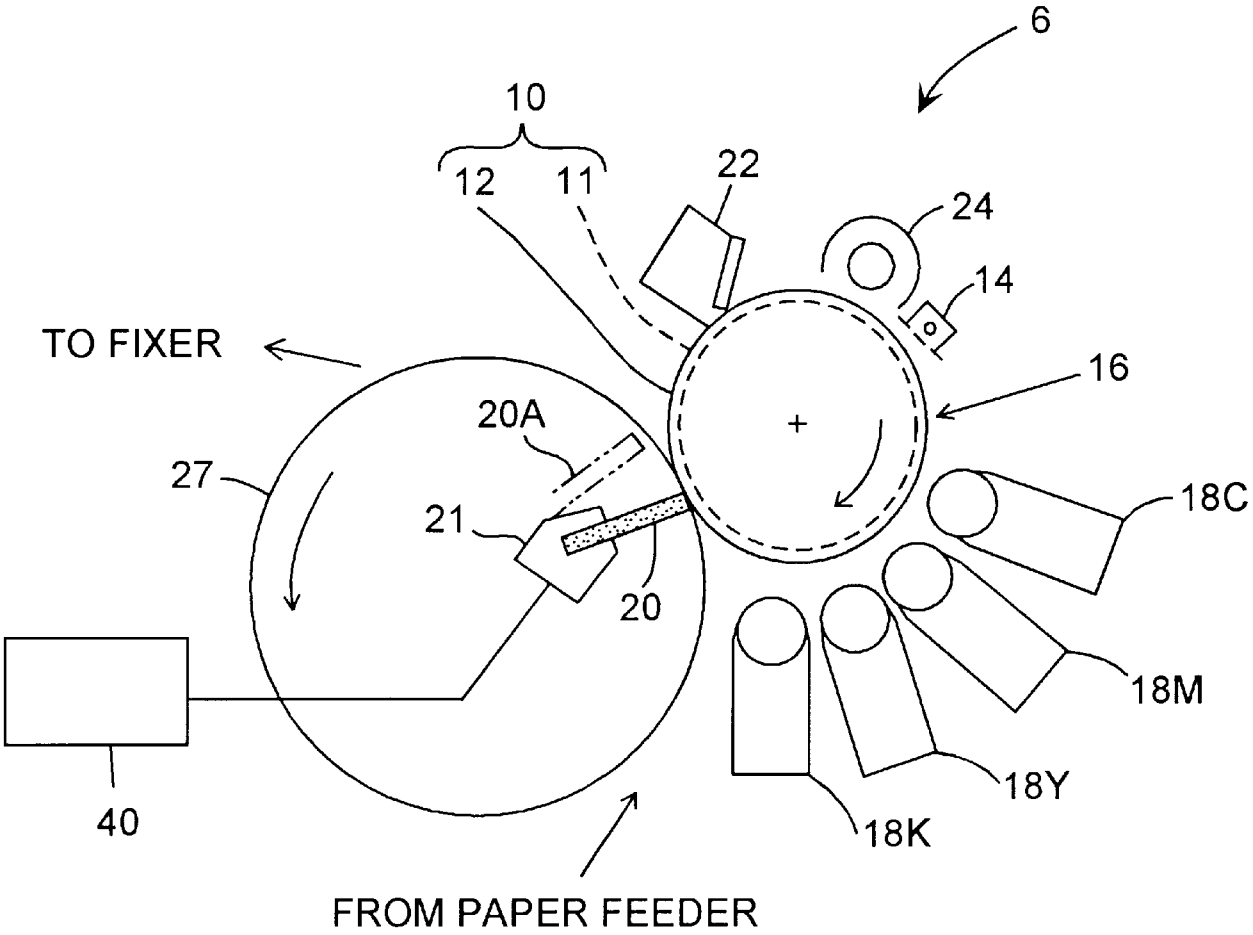
FIG. 10 is a schematic diagram showing the image forming apparatus based on a ninth embodiment of this invention.

FIG. 10 shows the principal portion of an image forming apparatus 6 based on the ninth embodiment of this invention. The apparatus is of non-tandem type, having a single photosensitive drum.

The apparatus 6 includes a photosensitive drum 10 which consists of a base cylinder 11 and a photosensitive layer 12 formed on it, and a charger 14, a light exposure device 16, a transfer drum 27, a cleaner 22 and a charge eliminater 24 all disposed to surround the photosensitive drum 10. These devices are used commonly for all colors. Further disposed around the photosensitive drum 10 are developers 18C, 18M, 18Y and 18K provided for four colors of cyanine, magenta, yellow and black.

The transfer drum 27 is designed to turn, with a sheet of print paper being borne on the external surface thereof. Disposed inside the transfer drum 27 are a transfer power source 21 and a transfer brush 20, which is in contact with the inner surface of the drum 27. The transfer brush 20 is provided with the same moving mechanism as shown in FIG. 1 so that the contact position can be varied.

The basic image forming operation of the image forming apparatus 6 is as follows. The photosensitive drum 10 is turned in the clockwise direction on the drawing, while the transfer drum 27 is turned in the counterclockwise direction on the drawing in synchronism in surface speed with the drum 10, with a sheet of print paper being fed thereto by the paper feed system (not shown).

The charger 14 is activated to charge the photosensitive layer 12 of the turning drum 10 to have a prescribed potential and the exposure device 16 is activated to emit a laser beam, which is modulated by image data of cyanine color, to the photosensitive layer 12 so that a static latent image is formed. Laser beam emission by the exposure device 16 is synthesized with the movement of print paper on the transfer drum 27. Toner of cyanine color, which is charged negatively by the developer 18C, is put to the static latent image, and the latent image is converted into a cyanine toner image.

During the image forming process, the transfer drum 27 is charged positively on its inner side by the transfer brush 20, and an electric field is produced at the closest position between the transfer drum 27 and the photosensitive drum 10, i.e., transfer zone. When the toner image of cyanine color on the photosensitive layer 12 reaches the transfer zone, toner is attracted by the electric field and the image is transferred to the print paper.

The print paper, with the toner image being transferred thereto, stays on the transfer drum 27 at this time, and the transfer drum 27 and photosensitive drum 10 turn continuously. Following the removal of residual toner by the cleaner 22 and the adjustment of potential by the charge eliminater 24, the photosensitive layer 12 of the drum 10 is charged again to the prescribed potential by the charger 14.

The exposure device 16 is activated to emit a laser beam, which is modulated by image data of magenta color, to the photosensitive layer 12, and a static latent image is formed. The laser beam emission by the exposure device 16 is synthesized with the movement of print paper on the transfer drum 27. Toner of magenta color, which is charged negatively by the developer 18M, is put to the static latent image, and the latent image is converted into a magenta toner image. When the magenta toner image on the photosensitive layer 12 reaches the transfer zone, it is transferred to the print paper in the same manner as the cyanine-color image.

Toner image formation and transfer for yellow and black colors take place successively, and the toner images of cyanine, magenta, yellow and black colors are transferred one by one onto the print paper by being superimposed. The print paper, with the toner images of four colors being transferred thereto, is peeled off the transfer drum 27 and passed to the fixer, by which the superimposed toner images are rendered the heat treatment for fixing, and a colored image is printed on the print paper.

Besides the foregoing basic operation, the image forming apparatus 6 implements the control for varying the contact position of the transfer brush 20 on the transfer drum 27 at the transfer of black toner image with the intention of preventing the dropout of toner image on the print paper even after the photosensitive layer 12 wears thin due to the long-term use, as in the case of the first embodiment.

The apparatus 6, when it has a new photosensitive layer 12 with a sufficient thickness, initializes the transfer output so that the dropout of image does not occur even if the contact position of the transfer brush 20 on the transfer drum 27 is brought closest to the transfer zone (shown by the filled image in FIG. 10).

In case the photosensitive layer 12 wears thin due to the repeated use, in which case the dropout of image can possibly occur, the decreased impedance of the photosensitive layer 12 is offset based on the compensatory increase of the impedance $Z_B$ of transfer drum 27 by measuring the thickness of photosensitive layer 12 and varying the contact position of the transfer brush 20 on the transfer drum 27.

Specifically, the transfer brush 20 is brought to the initial position on the transfer drum 27 (shown by the filled image in FIG. 10) if it is out of the position. The transfer drum 27 is operated to run idly to carry the print paper out of the transfer zone and remove residual toner. The transfer power source 21 is activated as constant voltage source to apply a prescribed voltage to the base cylinder 11 and the output current is measured, or alternatively the power source 21 is used as constant current source and the voltage is measured. Resulting information on the thickness of photosensitive layer 12 is indicated to the general controller 40.

The general controller 40 varies the contact position of the transfer brush 20 on the transfer drum 27 (shown as transfer brush 20A by the dashed-line image in FIG. 10) by being timed to the transfer of black toner image. As a result, the distance from the transfer zone to the contact position varies (increases), causing the impedance $Z_B$ of transfer drum 27 to contribute increasingly to the values of $Z_0$ and $Z_1$, and image formation without the occurrence of dropout can be accomplished without incurring such a side effect of excessive transfer output as reverse (recurrent) transfer. Both impedances $Z_0$ and $Z_1$ of the transfer zone increase immediately after the contact position of the transfer brush 20 is varied, and therefore the transfer output needs to be increased in compensation.

The image forming apparatus 6 also implements the control for varying the contact position of the transfer brush 20 based on the impedance between the top and rear sides of print paper loaded on the transfer drum 27 in the same manner as the first embodiment. Namely, when the impedance between the top and rear sides of print paper is sufficiently large, the image forming apparatus 6 initializes the transfer output so that the dropout of image does not occur even if the contact position of the transfer brush 20 on the transfer drum 27 is brought closest to the transfer zone (shown by the filled image in FIG. 10). If, otherwise, the impedance $Z_P$ between the top and rear sides of print paper on the transfer drum 27 is small, in which case the dropout can possibly occur, it is offset by increasing the impedance $Z_B$ of transfer drum 27.

Specifically, at the leading image transfer of cyanine color among the four colors of C, X, Y and K,, the transfer power source 21 is activated as constant voltage source to apply a prescribed voltage to the base cylinder and the output current is measured, or alternatively the power source 21 is used as constant current source and the voltage is measured, thereby measuring the impedance $Z_P$ between the top and rear sides of print paper in the paper area where the cyanine toner image is absent. The paper impedance measurement is affected by the thickness of photosensitive layer 12, and therefore it is measured in advance. The measured paper impedance is indicated to the general controller 40.

If the paper impedance $Z_P$ is smaller than normal, the general controller 40 varies the contact position of the transfer brush 20 on the transfer drum 27 by being timed to the transfer of black toner image. As a result, the difference of paper impedance $Z_P$ from the normal value is offset, and image formation without the occurrence of dropout can be accomplished without incurring such a side effect of excessive transfer output as reverse (recurrent) transfer. Both impedances $Z_0$ and $Z_1$ of the transfer zone increase immediately after the contact position of the transfer brush 20 is varied, and therefore the transfer output needs to be increased in compensation.

As described above in detail, the image forming apparatus 6 of this embodiment uses the transfer power source 21 and transfer brush 201 to get information on the thickness of photosensitive layer 12 at the image transfer of most crucial black color, and controls the contact position of the transfer brush 20 on the transfer drum 27 based on the information. Accordingly, even if the photosensitive layer 12 wears thin partially and has its impedance reduced due to the long-term use, it can be offset by increasing in compensation the impedance of the transfer drum 27 in its section from the transfer zone to the contact position of the transfer brush 20.

Accordingly, the apparatus can retain the difference of impedance between the toner image portion and non-toner image portion in the transfer zone and thus can retain the unevenness of transfer electric field distribution in the same degree as with a new photosensitive layer 12.

Consequently, the apparatus can perform image formation without the occurrence of dropout and without incurring such a side effect of excessive transfer output by the control as reverse (recurrent) transfer in the long-term use. Thus, the inventive apparatus performs high-quality image formation without the occurrence of dropout throughout the operating life of the photosensitive layer 12.

In addition, for the acquisition of information on the thickness of photosensitive layer 12, the transfer power source 21 and transfer brush 20 are used, instead of providing additional component parts, so that the apparatus is prevented from becoming complex in structure and large in size. Based on the determination of the thickness of photosensitive layer 12 from the impedance between the base cylinder 11 and the transfer power source 21, the total impedance variation inclusive of other causes of impedance variation than the thickness of photosensitive layer 12 can be included in the control.

Furthermore, the apparatus 6 measures the impedance $Z_P$ between the top and rear sides of print paper and control the contact position of the transfer brush 20 on the transfer drum 27 at the image transfer of most crucial black color based on the measurement result. Accordingly, even if the print paper has a small impedance due to the kind of paper or the environment, it can be offset by increasing in compensation the impedance of the transfer drum 27 in its section from the transfer zone to the contact position of the transfer brush 20.

Accordingly, the apparatus can retain the difference of impedance between the toner image portion and non-toner image portion in the transfer zone and thus can retain the unevenness of transfer electric field distribution in the same degree as in the normal state. Consequently, the apparatus can perform image formation without the occurrence of dropout and without incurring such a side effect of excessive transfer output by the control as reverse (recurrent) transfer even for print paper having a smaller impedance. Thus, the inventive apparatus performs high-quality image formation without the occurrence of dropout irrespective of the physical state of print paper.

The measurement of paper impedance $Z_P$ is implemented by using the transfer power source 21 and transfer brush 20, instead of providing additional component parts, so that the apparatus is prevented from becoming complex in structure and large in size. Based on the measurement of paper impedance $Z_P$ at the transfer of cyanine-color image that precedes the transfer of black-color image for each sheet of print paper for the determination of the position of transfer brush 20 at the transfer of black-color image, the apparatus implements the optimal position control of the transfer brush 20 to meet even a successive feed of print paper of different kinds.

The foregoing embodiment does not impose any limitation on the present invention, but instead, various alterations and modifications are obviously possible without departing from the essence of the invention. For example, the variants explained in connection with the first embodiment are also relevant to this embodiment. The transfer brush moving mechanism may be replaced with the brush switching mechanism, as in the case of the second embodiment.

Embodiment 10

Figure 11:
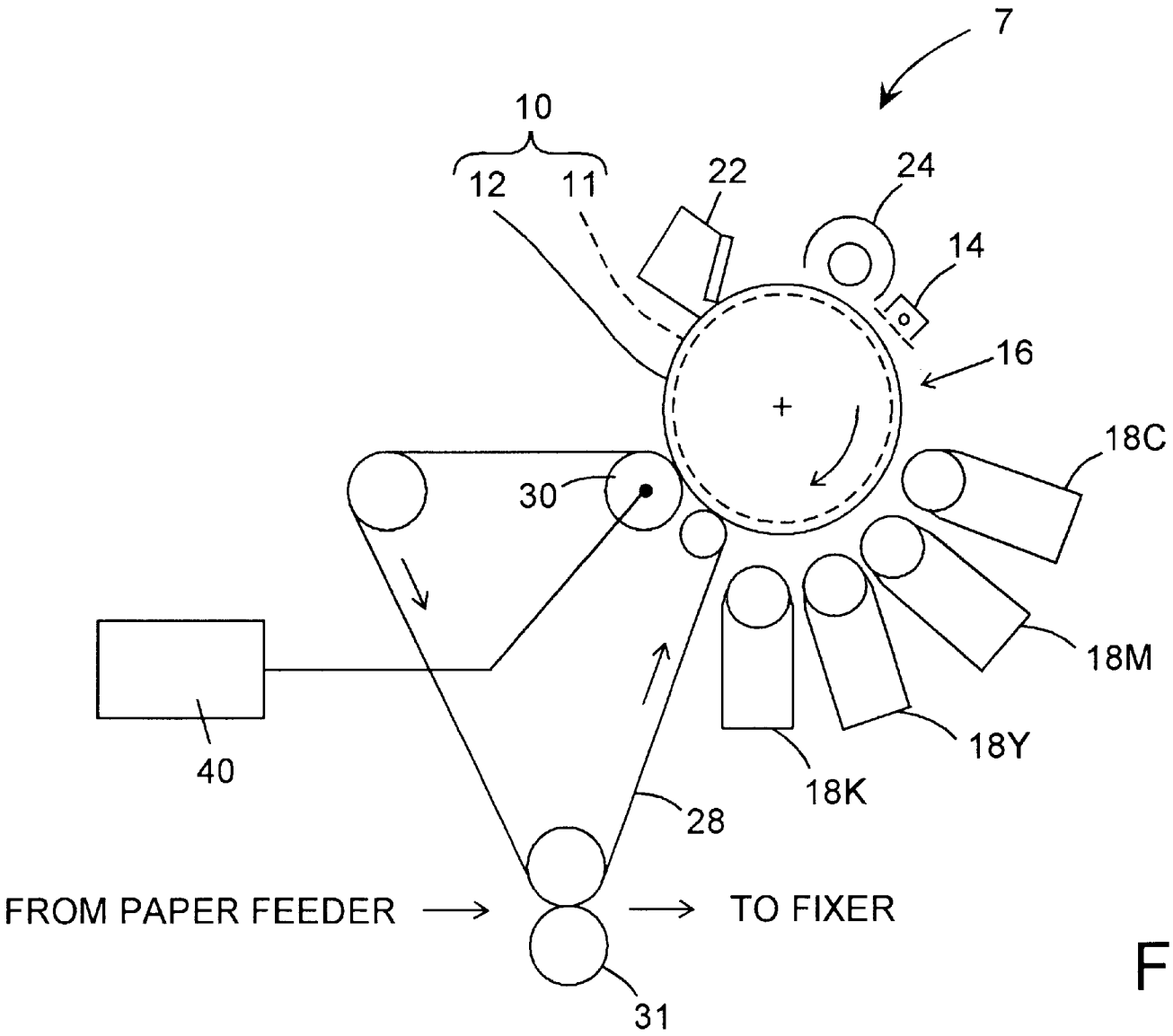
FIG. 11 is a schematic diagram showing the image forming apparatus based on a tenth embodiment of this invention.

FIG. 11 shows the principal portion of an image forming apparatus 7 based on the tenth embodiment of this invention. This apparatus is of non-tandem type as of the ninth embodiment, and employs an intermediate transfer belt 28. Disposed inside the intermediate transfer belt 28 is a primary transfer roller 30 which serves to transfer the toner image on the photosensitive layer 12 onto the intermediate transfer belt 28, while disposed outside the intermediate transfer belt 28 is a secondary transfer roller 31 which serves to transfer the toner image on the intermediate transfer belt 28 onto the print paper. The primary transfer roller 30 can vary the position.

The basic image forming operation of the image forming apparatus 7 is as follows. The photosensitive drum 10 is turned in the clockwise direction on the drawing, while the intermediate transfer belt 28 is run in the counterclockwise direction on the drawing in synchronism in surface speed with the drum 10. Toner image formation on the photosensitive layer 12 and image transfer onto the intermediate transfer belt 28 take place sequentially in the order of the colors of cyanine, magenta, yellow and black.

Toner image formation for all colors and running of the intermediate transfer belt 28 are synchronized, so that the toner images of all colors are transferred by being superimposed in the same place of the intermediate transfer belt 28. During this primary transfer operation, the secondary transfer roller 31 is kept off.

In response to the completion of toner image transfer for the four colors onto the intermediate transfer belt 28, a sheet of print paper is fed by the paper feed system (not shown) to the position between the intermediate transfer belt 28 and the secondary transfer roller 31, and the secondary transfer roller 31 is turned on to transfer the superimposed toner images on the intermediate transfer belt 28 onto the print paper. The print paper, with the toner images being transferred thereto, is carried to the fixer (not shown), by which the superimposed color toner images are rendered the heat treatment for fixing, and a colored image is printed on the print paper.

Besides the foregoing basic operation, the image forming apparatus 7 implements the control for varying the position of the primary transfer roller 30 at the primary transfer of black toner image with the intention of preventing the dropout of toner image on the intermediate transfer belt 28 even after the photosensitive layer 12 wears thin due to the long-term use.

Specifically, the intermediate transfer belt 28 is operated to run idly to remove residual toner from the transfer zone. In this state, a prescribed voltage is applied to the primary transfer roller 30 relative to the base cylinder 11 and the current is measured, or alternatively a prescribed current is supplied and the voltage is measured. Resulting information on the thickness of photosensitive layer 12 is indicated to the general controller 40.

The general controller 40 varies the position of the primary transfer roller 30 by being timed to the transfer of black toner image. As a result, the distance from the primary transfer zone to the roller position varies (increases), causing the impedance $Z_B$ of intermediate transfer belt 28 to contribute increasingly to the values of $Z_0$ and $Z_1$, and image formation without the occurrence of dropout can be accomplished without incurring such a side effect of excessive transfer output as reverse (recurrent) transfer. Both impedances $Z_0$ and $Z_1$ of the primary transfer zone increase immediately after this position control, and therefore the transfer output needs to be increased in compensation.

As described above, the image forming apparatus 7 of this embodiment gets information on the thickness of photosensitive layer 12 at the primary image transfer of the most crucial black color, and controls the position of primary transfer roller 30 based on the information. Accordingly, even if the photosensitive layer 12 wears thin partially and has its impedance reduced due to the long-term use, it can be offset by increasing in compensation the impedance of the section from the primary transfer zone to the primary transfer roller 30.

Accordingly, the apparatus can retain the difference of impedance between the toner image portion and non-toner image portion in the primary transfer zone and thus can retain the unevenness of transfer electric field distribution in the same degree as with a new photosensitive layer 12.

Consequently, the apparatus can perform image formation without the occurrence of dropout and without incurring such a side effect of excessive transfer output by the control as reverse (recurrent) transfer in the long-term use. Thus, the inventive apparatus performs high-quality image formation without the occurrence of dropout throughout the operating life of the photosensitive layer 12.

The foregoing embodiment does not impose any limitation on the present invention, but instead, various alterations and modifications are obviously possible without departing from the essence of the invention. For example, the variants explained in the foregoing embodiments are equally applicable to this embodiment.

What is claimed is:

1. An image forming apparatus comprising:

an image retaining medium which retains a latent image on the surface thereof;

a developing device which produces a visual image from the latent image that is retained on said image retaining medium;

a transfer device which transfers the visual image formed on said image retaining medium onto a transfer target medium;

a state sensing device which detects the state of said image retaining medium;

an impedance varying device which varies the impedance between said image retaining medium and said transfer device in accordance with the result of detection by said state sensing device; and a carrying belt which transports said transfer target medium to pass through the gap between said image retaining medium and said transfer device, said transfer device including a contact transfer device which charges said carrying belt by being in contact with the rear side thereof, said impedance varying device including a position varying device which varies the contact position of said contact transfer device on the rear side of said carrying belt.

2. An image forming apparatus according to claim 1, wherein said image retaining medium includes a conductive base and a photosensitive layer, said state sensing device detecting the thickness of said photosensitive layer.

3. An image forming apparatus according to claim 2 further including a contact charging device which charges said photosensitive layer by being in contact therewith, said state sensing device detecting the thickness of said photosensitive layer based on the measurement of the impedance of said photosensitive layer in terms of the relation of the current and voltage on said contact charging device.

4. An image forming apparatus according to claim 2 further including a carrying belt which transports said transfer target medium to pass through the gap between said image retaining medium and said transfer device, said transfer device including a contact transfer device which charges said carrying belt by being in contact with the rear side thereof, said state sensing device detecting the thickness of said photosensitive layer based on the measurement of the impedance of said photosensitive layer in terms of the relation of the current and voltage on said contact transfer device.

5. An image forming apparatus according to claim 2, wherein said state sensing device detects the thickness of said photosensitive layer by counting the number of times of image formation.

6. An image forming apparatus according to claim 2 further including a sensor which detects a surface potential value of the photosensitive layer, said state sensing device detecting the thickness of said photosensitive layer based on the measurement of the surface potential value.

7. An image forming apparatus comprising:

an image retaining medium which retains a latent image on the surface thereof;

a developing device which produces a visual image from the latent image that is retained on said image retaining medium;

a transfer device which transfers the visual image formed on said image retaining medium onto a transfer target medium;

an impedance measuring device which measures the impedance between the top and rear sides of said transfer target medium;

an impedance varying device which varies the impedance between said image retaining medium and said transfer device in accordance with the result of measurement by said impedance measuring device; and a carrying belt which transports said transfer target medium to pass through the gap between said image retaining medium and said transfer device, said transfer device including a contact transfer device which charges said carrying belt by being in contact with the rear side thereof, said impedance varying device including a position varying device which varies the contact position of said contact transfer device on the rear side of said carrying belt.

8. An image forming apparatus comprising:

an image retaining medium which retains a latent image on the surface thereof;

a developing device which produces a visual image from the latent image that is retained on said image retaining medium;

a transfer device which transfers the visual image formed on said image retaining medium onto a transfer target medium;

a state sensing device which detects the state of said image retaining medium;

an impedance measuring device which measures the impedance between the top and rear sides of said transfer target medium; and an impedance varying device which varies the impedance between said image retaining medium and said transfer device in accordance with the result of detection by said state sensing device and the result of measurement by said impedance measuring device.

9. An image forming apparatus having at least one image forming unit which comprises:

an image retaining medium which retains a latent image on the surface thereof;

a developing device which produces a visual image from the latent image that is retained on said image retaining medium;

a transfer device which transfers the visual image formed on said image retaining medium onto a transfer target medium;

a state sensing device which detects the state of said image retaining medium;

an impedance varying device which varies the impedance between said image retaining medium and said transfer device in accordance with the result of detection by said state sensing device; and a carrying belt which transports said transfer target medium to pass through the gap between said image retaining medium and said transfer device, said transfer device including a contact transfer device which charges said carrying belt by being in contact with the rear side thereof, said impedance varying device including a position varying device which varies the contact position of said contact transfer device on the rear side of said carrying belt.

10. An image forming apparatus according to claim 9 including a plurality of said image forming unit.

11. An image forming apparatus according to claim 10, wherein the first of said image forming units and the second of said image forming units have different impedances between said image retaining medium and said transfer device.

12. An image forming apparatus according to claim 9 further including a carrying belt which transports said transfer target medium to pass through the gap between said image retaining medium and said transfer device, said transfer device including a plurality of contact transfer devices having different impedances which charge said carrying belt by being in contact with the rear side thereof, said impedance varying device including a switching device which switches among said contact transfer devices.

13. An image forming apparatus according to claim 9, wherein said image retaining medium includes a conductive base and a photosensitive layer, said state sensing device detecting the thickness of said photosensitive layer.

14. An image forming apparatus according to claim 13 further including a contact charging device which charges said photosensitive layer by being in contact therewith, said state sensing device detecting the thickness of said photosensitive layer based on the measurement of the impedance of said photosensitive layer in terms of the relation of the current and voltage on said contact charging device.

15. An image forming apparatus according to claim 13 further including a carrying belt which transports said transfer target medium to pass through the gap between said image retaining medium and said transfer device, said transfer device including a contact transfer device which charges said carrying belt by being in contact with the rear side thereof, said state sensing device detecting the thickness of said photosensitive layer based on the measurement of the impedance of said photosensitive layer in terms of the relation of the current and voltage on said contact transfer device.

16. An image forming apparatus according to claim 13, wherein said state sensing device detects the thickness of said photosensitive layer by counting the number of times of image formation.

17. An image forming apparatus according to claim 13 further including a sensor which detects a surface potential value of the photosensitive layer, said state sensing device detecting the thickness of said photosensitive layer based on the measurement of the surface potential value.

18. An image forming apparatus having at least one image forming unit which comprises:

an image retaining medium which retains a latent image on the surface thereof;

a developing device which produces a visual image from the latent image that is retained on said image retaining medium;

a transfer device which transfers the visual image formed on said image retaining medium onto a transfer target medium;

an impedance measuring device which measures the impedance between the top and rear sides of said transfer target medium;

an impedance varying device which varies the impedance between said image retaining medium and said transfer device in accordance with the result of measurement by said impedance measuring device; and a carrying belt which transports said transfer target medium to pass through the gap between said image retaining medium and said transfer device, said transfer device including a contact transfer device which charges said carrying belt by being in contact with the rear side thereof, said impedance varying device including a position varying device which varies the contact position of said contact transfer device on the rear side of said carrying belt.

19. An image forming apparatus according to claim 18 including a plurality of said image forming unit.

20. An image forming apparatus according to claim 19, wherein the first of said image forming units and the second of said image forming units have different impedances between said image retaining medium and said transfer device.

21. An image forming apparatus having at least one image forming unit which comprises:

an image retaining medium which retains a latent image on the surface thereof;

a developing device which produces a visual image from the latent image that is retained on said image retaining medium;

a transfer device which transfers the visual image formed on said image retaining medium onto a transfer target medium;

a state sensing device which detects the state of said image retaining medium;

an impedance measuring device which measures the impedance between the top and rear sides of said transfer target medium; and an impedance varying device which varies the impedance between said image retaining medium and said transfer device in accordance with the result of detection by said state sensing device and the result of measurement by said impedance measuring device.

22. An image forming apparatus according to claim 21 including a plurality of said image forming unit.

23. An image forming apparatus according to claim 22, wherein the first of said image forming units and the second of said image forming units have different impedances between said image retaining medium and said transfer device.

24. An image forming method comprising the steps of:

forming an image by the steps of forming a latent image on an image retaining medium, producing a visual image from the latent image retained on the image retaining medium and transferring the visual image onto a transfer target medium by means of a transfer device;

detecting a state of said image retaining medium; and varying an impedance between said image retaining medium and said transfer device by varying a position of the transfer device in accordance with the detected state of said image retaining medium.

25. An image forming method according to claim 24, further comprising the step of measuring an impedance between the top and rear sides of said transfer target medium, and said impedance varying step varying the impedance between said image retaining medium and said transfer device in accordance with the detected state of said image retaining medium and the measured impedance between the top and rear sides of said transfer target medium.

26. An image forming method comprising the steps of:

forming an image by the steps of forming a latent image on an image retaining medium, producing a visual image from the latent image retained on the image retaining medium and transferring the visual image onto a transfer target medium by means of a transfer device;

measuring an impedance between the top and rear sides of said transfer target medium; and varying an impedance between said image retaining medium and said transfer device by varying a position of the transfer device in accordance with the measured impedance between the top and rear sides of said transfer target medium.

* * * * *